US007174593B2

(12) United States Patent
Soejima et al.

(10) Patent No.: US 7,174,593 B2
(45) Date of Patent: Feb. 13, 2007

(54) VACUUM CLEANER HAVING AN ION GENERATOR

(75) Inventors: Masakuni Soejima, Shiga (JP); Yasushi Kondo, Shiga (JP); Yoshihiro Taniguchi, Osaka (JP); Ryohei Yoshida, Shiga (JP); Masaki Shibuya, Shiga (JP); Seiji Yamaguchi, Shiga (JP); Saburo Kajikawa, Shiga (JP); Hidenori Kitamura, Shiga (JP); Hiroyuki Uratani, Shiga (JP); Kouichi Fujita, Shiga (JP); Haruka Ishikawa, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 391 days.

(21) Appl. No.: 10/327,879

(22) Filed: Dec. 26, 2002

(65) Prior Publication Data

US 2003/0140444 A1 Jul. 31, 2003

(30) Foreign Application Priority Data

| | | |
|---|---|---|
| Dec. 27, 2001 | (JP) | 2001-396394 |
| Mar. 4, 2002 | (JP) | 2002-057174 |
| Apr. 17, 2002 | (JP) | 2002-114547 |
| Oct. 9, 2002 | (JP) | 2002-296249 |

(51) Int. Cl.
*A47L 9/04* (2006.01)

(52) U.S. Cl. ..... 15/1.51; 15/383

(58) Field of Classification Search ..... 15/1.51, 15/319, 339, 327.1–327.7, 347, 350–353, 15/363, 366, 377, 383; 96/39, 61, 94, 97; 55/DIG. 3; 361/230–235; 422/186, 186.04, 422/186.05, 186.06, 186.07, 186.1, 186.13
See application file for complete search history.

(56) References Cited

U.S. PATENT DOCUMENTS

| | | | | |
|---|---|---|---|---|
| 2,297,933 | A | 10/1942 | Yonkers, Jr. | |
| 4,282,626 | A | 8/1981 | Schneider | |
| 5,257,079 | A * | 10/1993 | Lange et al. | 399/354 |
| 5,405,434 | A | 4/1995 | Inculet | |
| 5,920,954 | A | 7/1999 | Sepponen | |
| 6,171,375 | B1 * | 1/2001 | Howie | 96/17 |
| 6,199,244 | B1 * | 3/2001 | Hilgers et al. | 15/339 |
| 6,740,144 | B2 * | 5/2004 | Conrad et al. | 96/57 |
| 6,761,773 | B1 * | 7/2004 | McKechnie et al. | 134/1 |

FOREIGN PATENT DOCUMENTS

| | | |
|---|---|---|
| DE | 19933180 | 1/2001 |
| EP | 1097666 | 5/2001 |
| FR | 2490110 | 3/1982 |
| GB | 1501927 | 2/1978 |
| JP | 62-109531 | 5/1987 |
| JP | 1-160517 * | 6/1989 |

(Continued)

*Primary Examiner*—Terrence R. Till
(74) *Attorney, Agent, or Firm*—Bacon & Thomas, PLLC

(57) ABSTRACT

A vacuum cleaner includes an electric blower for generating a suction air flow, a suction head in communication with the electric blower for drawing in dirt, a filter bag communication with the electric blower for capturing and collecting dirt, an exhaust unit for discharging exhaust air from the electric blower to atmosphere, and an ion generator for generating negative ions and/or positive ions. The ion generator is placed between the suction head and the filter bag.

18 Claims, 20 Drawing Sheets

FOREIGN PATENT DOCUMENTS

| | | | |
|---|---|---|---|
| JP | 3-45229 | * | 7/1989 |
| JP | 1-209033 | * | 8/1989 |
| JP | 3-41921 | * | 2/1991 |
| JP | 5-253148 | * | 3/1992 |
| JP | 10248769 | | 9/1998 |
| JP | 10295594 | | 11/1998 |
| JP | 11-216089 | * | 8/1999 |
| KR | 2001-614880 | * | 6/2001 |

* cited by examiner

FIG. 17

| (POSITIVE SIDE) | | |
|---|---|---|
| ASBESTOS | ALUMINUM | VINYLON |
| GLASS | ZINC | POLYSTYRENE |
| MICA | CHROMIUM | SARAN |
| NYLON | PAPER | DACRON |
| SHEEP WOOL | EBONITE | DYNEL |
| RAYON | HEMP | VINYLIDENE |
| LEAD | IRON | CARBIDE |
| COTTON | COPPER | POLYETHYLENE |
| SILK | NICKEL | KANECARON |
| VISCOSE | BRASS | CELLULOID |
| SKIN | SILVER | CELLOPHANE |
| CASEIN | SULFUR | VINYL CHLORIDE |
| ACETATE | BLACK RUBBER | TEFLON |
| ACRYL | PLATINA | NITROCELLULOSE |
| | | (NEGATIVE SIDE) |

VACUUM CLEANER HAVING AN ION GENERATOR

FIELD OF THE INVENTION

The present invention relates to a vacuum cleaner; and, more particularly, to a vacuum cleaner having at least one ion generator for generating negative ions and/or positive ions.

BACKGROUND OF THE INVENTION

Referring to FIGS. 1 and 2 there are shown a perspective view of a typical vacuum cleaner and a schematic internal structure of a main body thereof as described in Japanese Laid-Open Publication No. 1987-109531, respectively.

As shown in FIG. 1, the typical vacuum cleaner includes a main body 1 having a dirt collection chamber 6 provided with a connection port 1A; an extension tube 3 provided with a handle 5 at one of its ends for controlling an electric blower 7 as will be described; a suction head 4, installed at the other end of the extension tube 3, for an intake of dirt entraining air; and a hose 2 for interconnecting the connection port 1A to the handle 5, whereby an air-flow path is provided between the main body 1 and the suction head 4.

As shown in FIG. 2, disposed in the main body 1 are an electric blower chamber 8 for mounting therein the electric blower 7 for a generation of suction and the dirt collection chamber 6 provided at the upstream of the suction generated by the electric blower 7. Specifically, in the dirt collection chamber 6 is installed a filter bag 12 made of paper as a dirt collecting means.

During the operation of the vacuum cleaner, dirt-laden air is drawn from a target cleaning surface and travels through the suction head 4, the extension tube 3 and the hose 2, capturing and trapping the dirt in the filter bag 12 and thereby allowing purified air to be discharged through exhaust outlets 9 of an exhaust unit.

Reference numerals 10 and 11 represent a pre-filter and an exhaust air filter, respectively.

In such a vacuum cleaner, it is difficult to filter out fine contaminants such as dandruff, sands, ticks, pollen, mildew and saprophytes and the like despite various attempts to provide an effective filtering thereof, for instance improving dirt drawing efficiency via the suction head 4, improving dirt collection to reduce amount of discharged dirt.

In addition, dirt accumulated in the filter bag 12 generates odor during the operation of the vacuum cleaner. Moreover, when dirt accumulated in the filter bag 12 is not disposed of relatively frequently, saprophytes may breed therein and be discharged via the exhaust outlets 9 during the operation of the vacuum cleaner, which needless to say is very unsanitary.

SUMMARY OF THE INVENTION

It is, therefore, a primary object of the present invention to provide a user-friendly vacuum cleaner including an ion generator, improving room air quality.

In accordance with a preferred embodiment of the present invention, there is provided a vacuum cleaner comprising:

an electric blower for generating a suction air flow;

a suction head communicated with the electric blower for drawing in dirt; and an ion generator for generating negative ions and/or positive ions.

When the ion generator generates the negative ions, an unpleasant odors generated by growth of bacteria or fungi on the dust particles captured in the filter bag is reduced and further positively charged particles are neutralized and are prevented from sticking to the air-flow path of the vacuum cleaner. Needless to say, generation of the positive ions by the ion generator further enhances the filtering of fine dust particles.

In accordance with another preferred embodiment of the present invention, there is provided a vacuum cleaner comprising:

an electric blower for generating a suction air flow;

a suction head in communication with the electric blower for drawing in dirt;

a filter bag for capturing and collecting dirt; and an ion generator placed in the suction head, for generating negative ions and/or positive ions.

In accordance with still another preferred embodiment of the present invention, there is provided a suction head for use in a vacuum cleaner comprising:

a dirt sucking chamber provided with a rotary brush, the rotary brush having a plurality of bristle clusters and the bristle clusters being made of a first material to be charged with electricity; and an ion generator for generating negative ions and/or positive ions, the ion generator being made of a second material to be charged with electricity, the second material having a different electrification rank from that of the first material, wherein the ion generator is charged with electricity by coming into frictional contact with the bristle clusters of the rotary brush, thereby generating the ions.

In accordance with further still another preferred embodiment of the present invention, there is provided a suction head for use in a vacuum cleaner comprising:

a wall part forming one or more opening portions, the opening portions being opened in a downward direction for sucking dust particles; and a bristle packet positioned on the wall part, the bristle packet including bristle clusters having different electrification ranks, wherein the bristle clusters are rubbed against each other to produce negative ions when the bristle packet is rubbed against a target cleaning surface.

In accordance with further still another preferred embodiment of the present invention, there is provided a suction head for use in a vacuum cleaner comprising:

a first and a second bristle packet, each being positioned in one or more opening portions or at peripheries of the opening portions, one or more opening portions being opened in a downward direction for sucking dust particles, and the first and the second bristle packet respectively including bristle clusters having different electrification ranks, wherein the first and the second bristle packet rotate to be rubbed against each other to thereby produce negative ions.

In accordance with further still another preferred embodiment of the present invention, there is provided a vacuum cleaner comprising:

a plurality of brush-like packets, each being positioned in one or more opening portions or at peripheries of the opening portions, the opening portions being opened in a downward direction for suctioning dust particles, and the plurality of bristle packets respectively including brushes of certain electrification ranks, wherein the plurality of the bristle packet come into contact with a target cleaning surface and at least one of the bristle packet rotates to be rubbed against another bristle packet having a different electrification rank, so that the other bristle packet produces negative ions.

BRIEF DESCRIPTION OF THE DRAWINGS

The above and other objects and features of the present invention will become apparent from the following description of preferred embodiments given in conjunction with the accompanying drawings in which:

FIG. 17 depicts a table showing electrification rank of various materials;

DETAILED DESCRIPTION OF THE PREFERRED EMBODIMENTS

Figure 1:
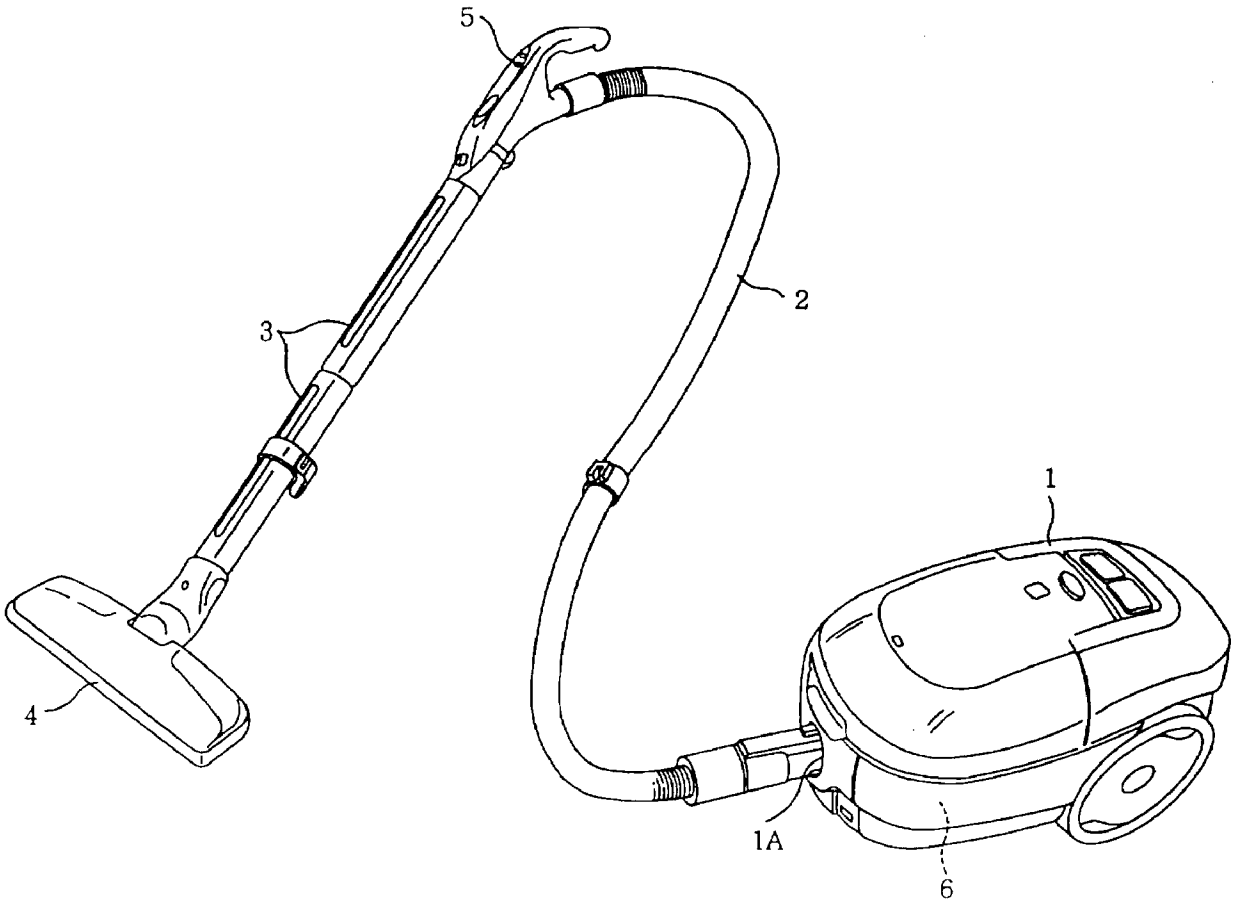
FIG. 1 presents a perspective view of a typical vacuum cleaner.
Figure 2:
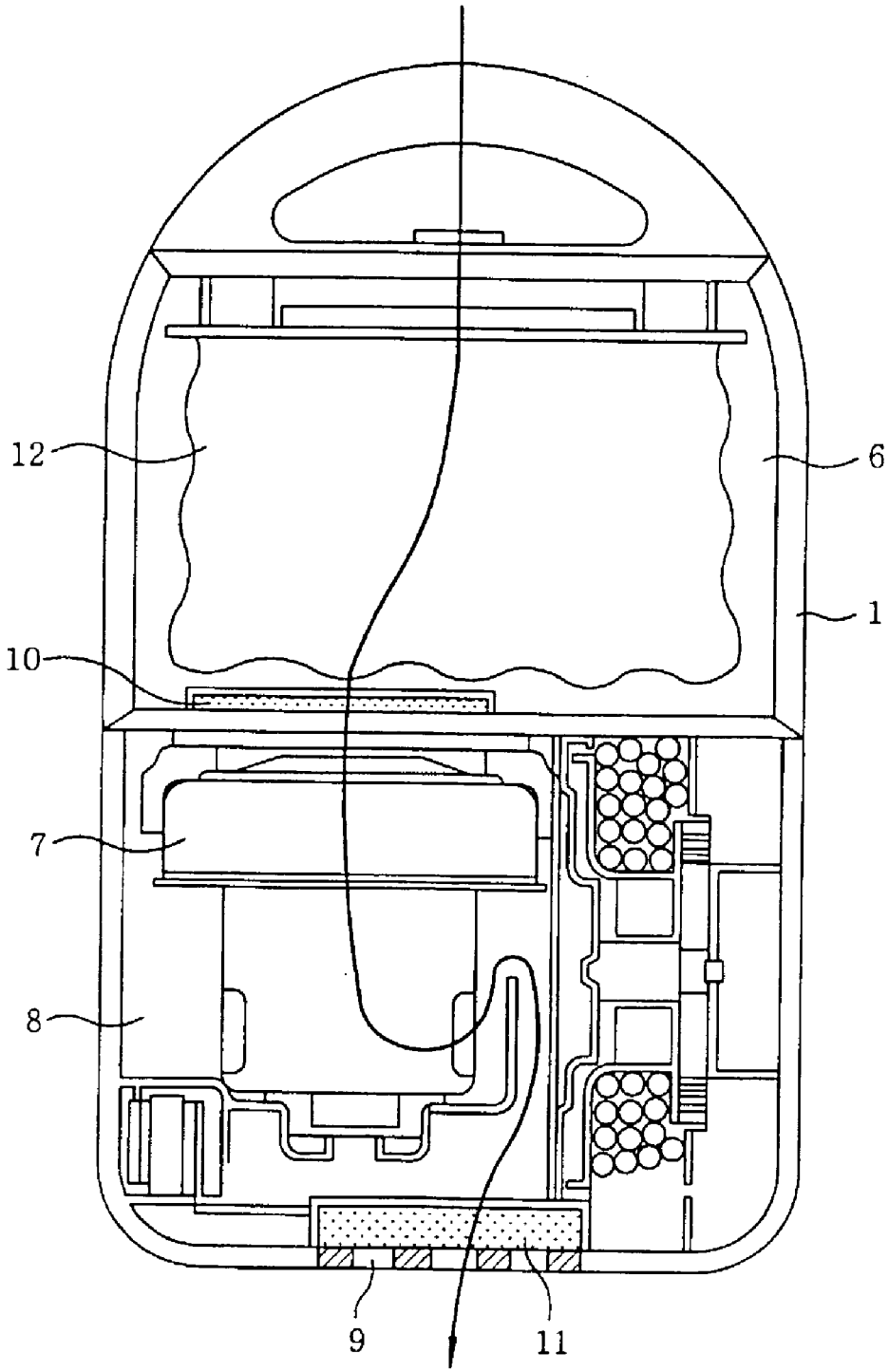
FIG.2 (PRIOR ART)
FIG. 2 shows a schematic internal structure of a main body of a vacuum cleaner of a prior art.

Preferred embodiments of the present invention will now be described in detail with reference to the accompanying drawings, wherein like reference numerals appearing in FIGS. 1 to 20C represent like parts.

A first preferred embodiment of the present invention will now be described in detail with reference to FIG. 3.

Figure 3:
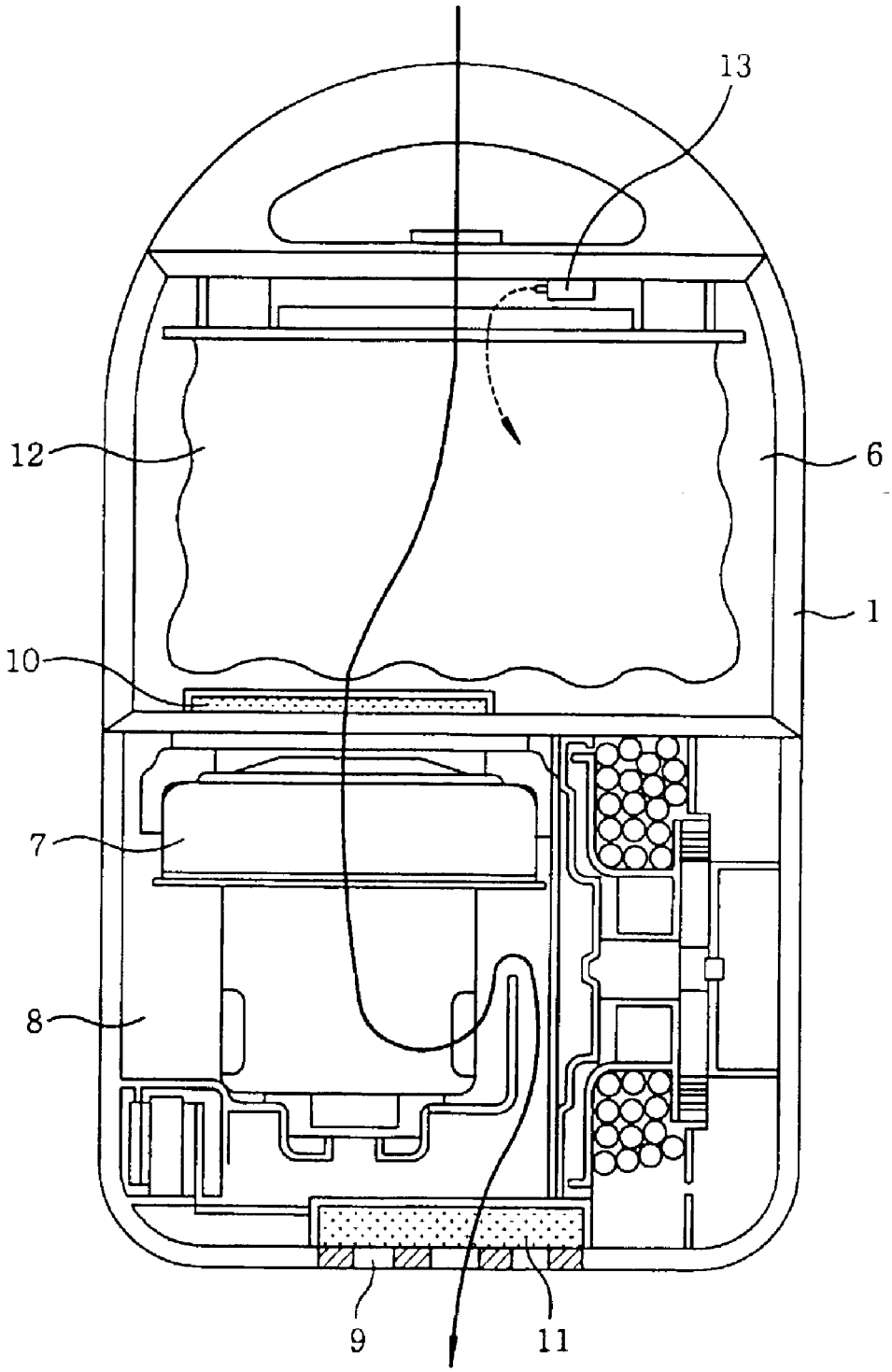
FIG. 3 represents a schematic internal structure of a main body of a vacuum cleaner in accordance with a first preferred embodiment of the present invention.

Referring to FIG. 3, there is shown a schematic internal structure of a main body 1 of a vacuum cleaner in accordance with the first preferred embodiment of the present invention. The main body 1 includes a dirt collection chamber 6, a filter bag 12 disposed in the dirt collection chamber 6 as a dirt collecting means for capturing and collecting dirt therein, an electric blower 7 for generating a suction, creating an air flow and forcibly drawing in dirt, an electric blower chamber 8 for mounting therein the electric blower 7, and an exhaust unit having exhaust outlets 9 for discharging the drawn air to atmosphere therethrough.

Reference numerals 10 and 11 represent a pre-filter and an exhaust air filter, respectively.

The first preferred embodiment of the present invention further includes an ion generator 13 for generating negative ions and/or positive ions. The ion generator 13 is installed at an intake of the dirt collection chamber 6 in such a manner that the generated ions are fed into the dirt collection chamber 6.

However, the placement of the ion generator 13 is not limited to the inside of the dirt collection chamber 6. It may be disposed in the hose 2 or the extension tube 3 shown in FIG. 1, as long as it is placed between the suction head 4 and the intake of the electric blower 7.

When the ion generator 13 disposed near the suction head 4 generates negative ions which travel through an air flow path, e.g., through the hose 2 and the extension tube 3, positively charged dust particles that are accumulated therein are released therefrom and follows the air flow path, thereby reducing the amount of dirt accumulated therein. Further, unpleasant odors and bacteria growth due to the dust particles accumulated in the hose 2, the extension tube 3, and the filter bag 12 can be controlled.

On the other hand, if positive ions are discharged from the ion generator 13, the unpleasant odors can be further reduced, due to more powerful deodorizing ability and antimicrobial action relative to the negative ions.

If both positive and negative ions are discharged, both of its respective advantages can be obtained.

Figure 4:
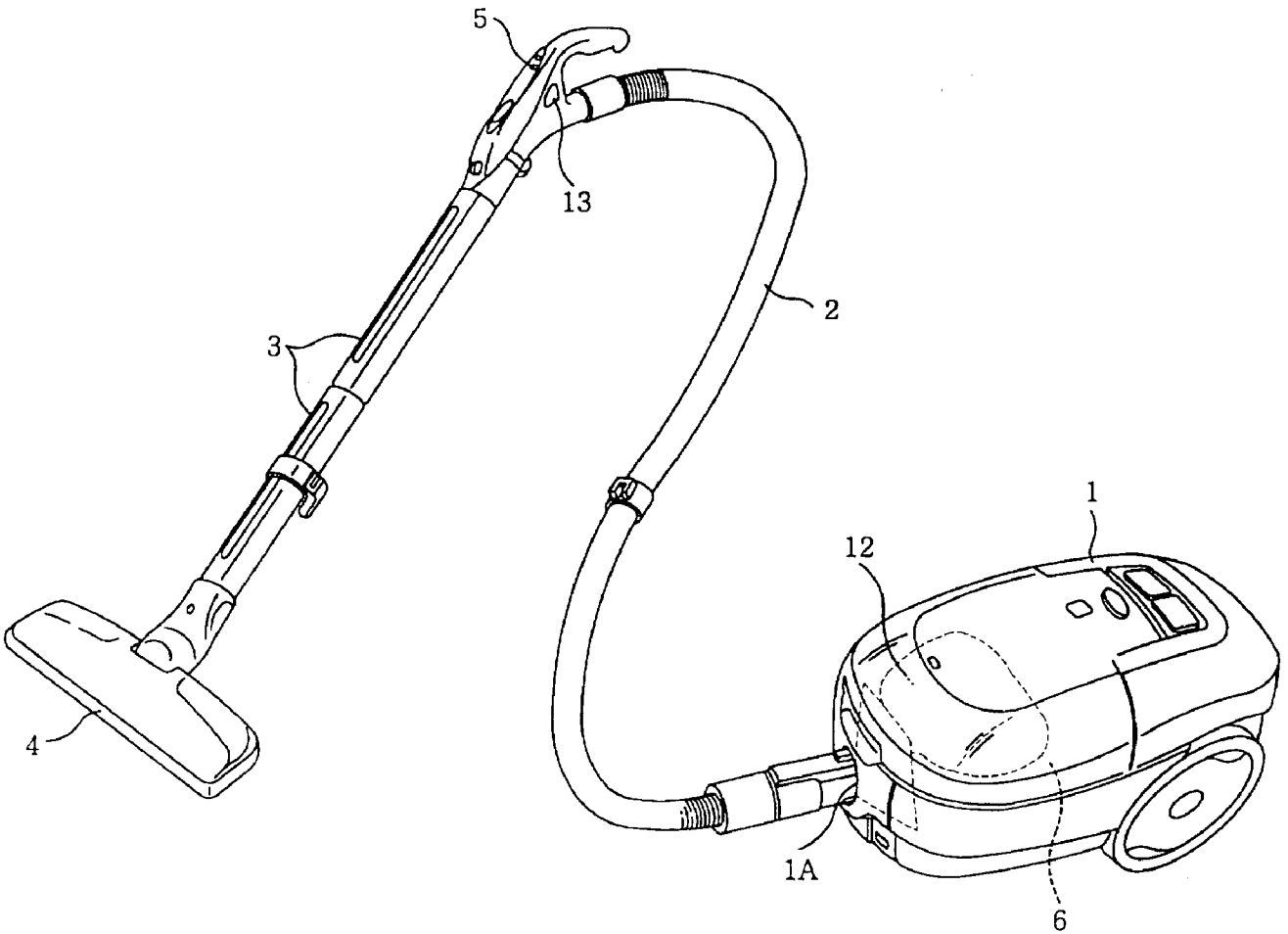
FIG. 4 illustrates a perspective view of a vacuum cleaner in accordance with a second preferred embodiment of the present invention.

A second preferred embodiment of the present invention will now be described in detail with reference to FIG. 4.

As shown, an ion generator 13 for generating negative ions and/or positive ions is installed in the handle 5 disposed between the suction head 4 and the dirt collection chamber 6.

Similar to the first preferred embodiment, the accumulation of dirt particles in the attachments, between the ion generator 13 and the main body 1, e.g., the hose 2, is reduced. Thereby odors and growth of bacterium are suppressed.

Figure 5:
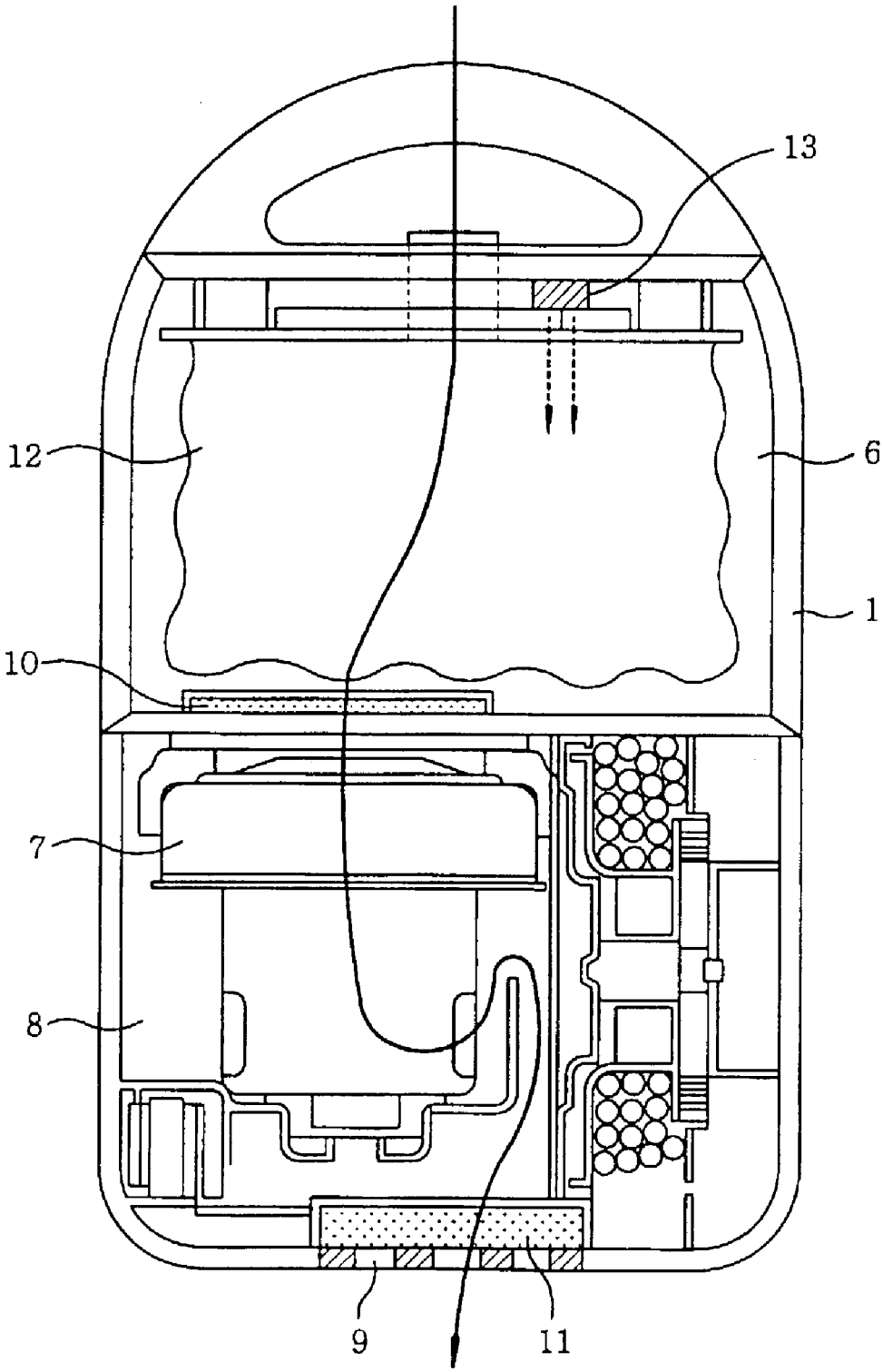
FIG. 5 sets forth a schematic internal structure of a main body of a vacuum cleaner in accordance with a third preferred embodiment of the present invention.

A third preferred embodiment of the present invention will now be described in detail with reference to FIG. 5.

As shown, an ion generator 13 for generating negative ions and/or positive ions is disposed in the dirt collection chamber 6 in such a way that the ions are targeted and directly supplied to the filter bag 12, which enhances the effectiveness of the deodorization, antimicrobial action and settling of dust particles.

A fourth preferred embodiment of the present invention will now be described in detail with reference to FIG. 6.

Figure 6:
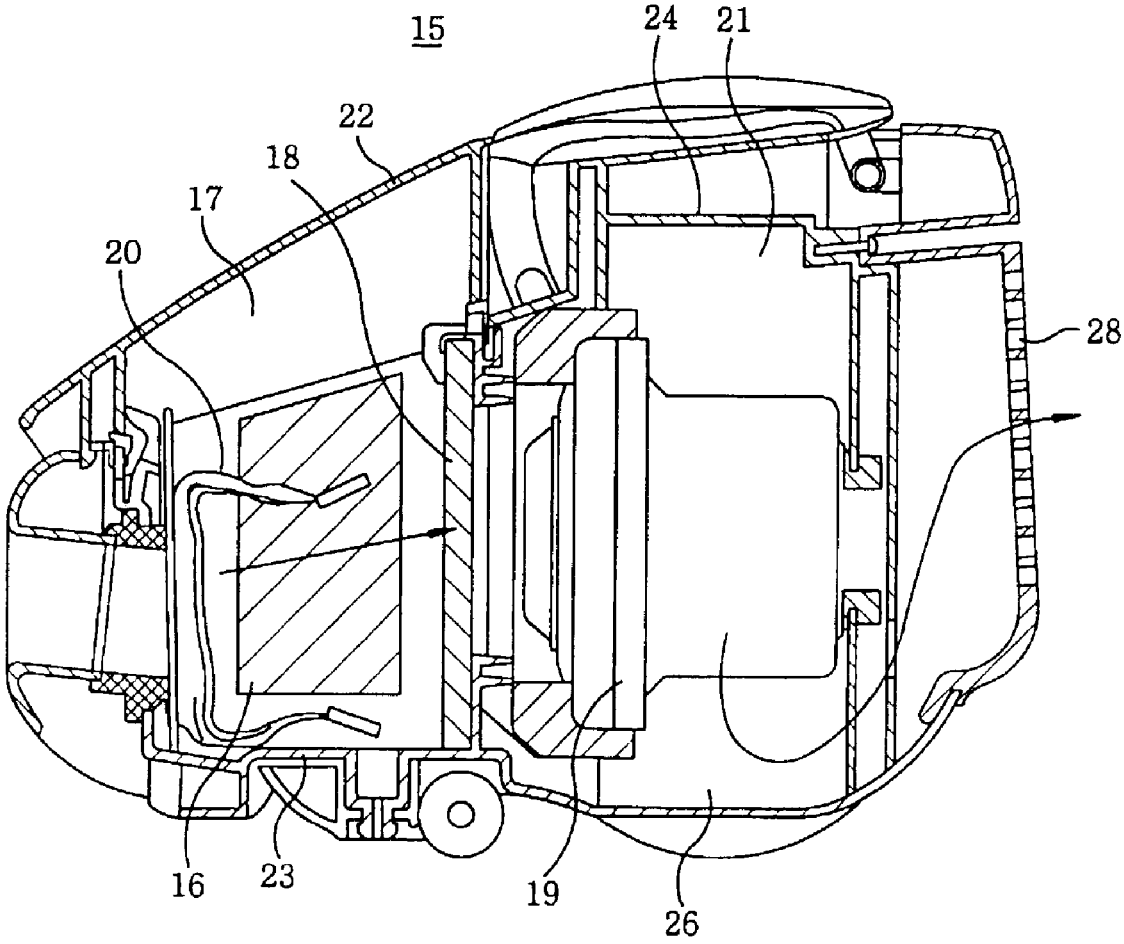
FIG. 6 discloses a side cross sectional view of a main body of a vacuum cleaner in accordance with a fourth preferred embodiment of the present.

There is shown in FIG. 6 a cross sectional view of a main body 15 of a vacuum cleaner in accordance with a fourth preferred embodiment of the present invention.

Included in a front portion of the main body 15 is a dirt collection chamber 17 for collecting dirt and to its rear is an electric blower chamber 21. The dirt collection chamber 17 has a lid 22 for providing an opening at its top portion for retrieving a filter bag 20. The electric blower chamber 21 is provided with an electric blower 19, which is fixedly supported on a lower and an upper casing 23 and 24 of the main body 15 for drawing dirt into the dirt collection chamber 17.

Reference numerals 16 and 18 represent ion generators A and B made of, e.g., Teflon or a vinyl chloride fiber for generating negative ions, respectively. The ion generator A 16 is detachably placed in the dirt collection chamber 17 and the ion generator B 18 is installed at the intake of the electric blower 19 to promote an air flow from the suction head 4 therethrough.

When the suction is generated by the electric blower 19 to create an air flow, the dirt-laden air is drawn into the filter bag 20 disposed in the dirt collection chamber 17 through the suction head 4, the extension tube 3 and the hose 2. Thereafter, the "filtered" air passes through the ion generator A 16. Subsequently, the ion generators A 16 and B 18 negatively ionize the air by generating static electricity as a result of friction with the moving air. Specifically, the ion generator B 18 is disposed near the upstream of the electric blower 19, thereby forcing greater production of negative ions.

Reference numerals 26 and 28 represent an air discharge passage through which air flow travels and exhaust openings for discharging out the air flow, respectively. The air discharge passage 26 is provided around periphery of the electric blower 19 and the exhaust openings 28 are disposed at a rear periphery of the main body 15.

By installing the negative ion generators A 16 and B 18 in the dirt collection chamber 17 of the main body 15, it minimizes the size of the main body, which adds convenience to the operator. Further, providing augmentations in number of ions present in the room induces relaxation and comfort to the operator.

Moreover, since the negative ion generators A 16 and B 18 are disposed at the intake or the upstream of the air flow of the electric blower 19, the positively charged dirt particles are reduced in the main body 15, thereby preventing such particles from escaping therefrom. In other words, the cleaning environment is enhanced. Moreover, in order to efficiently utilize the suction provided by the electric blower 19, the negative ion generator B 18 is placed near the intake thereof, thereby providing ample amount of negative ions therefrom.

Further, since the ion generators A 16 and B 18 utilize the negative ions generated by the frictional contact with the moving air created by the electric blower 19, a separate driving source is not required for the ionization to take place, to thereby simplify the construction of ion generators and reduce the cost thereof while providing a desired amount of the negative ions and comfort to the operator while cleaning.

Figure 7:
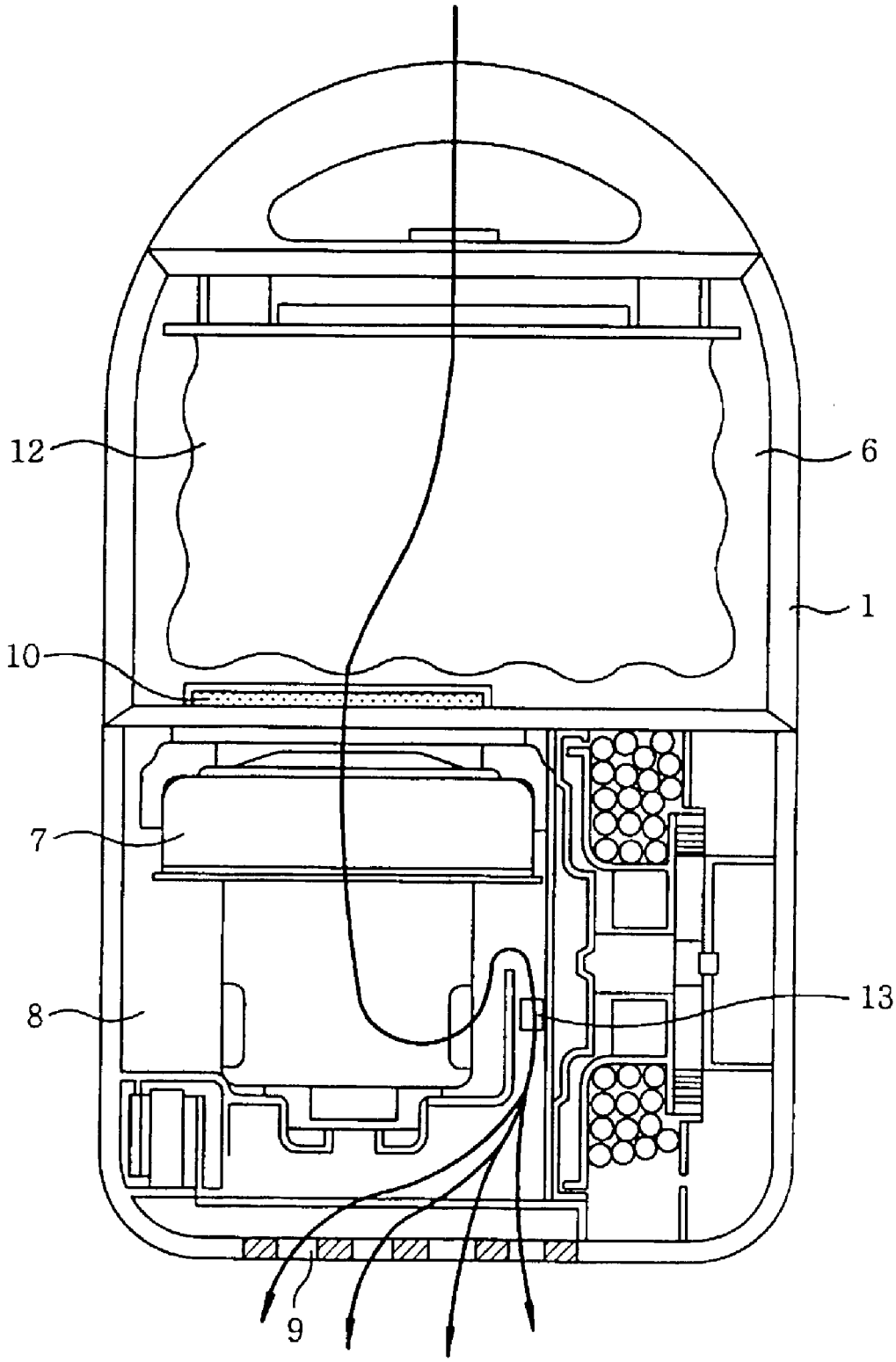
FIG. 7 offers a schematic internal structure of a main body of a vacuum cleaner in accordance with a fifth preferred embodiment of the present invention.

A fifth preferred embodiment of the present invention will now be described in detail with reference to FIG. 7.

As shown, an ion generator 13 for generating negative ions and/or positive ions is installed at a downstream of the electric blower 7.

When the electric blower 7 is activated, fine contaminants such as dust particles from clothes or bedding, hair or feather of an animal, dandruff, sands, ticks, pollen, mildew and saprophytes and the like are sucked from the suction head 4 into the filter bag 12. Thereafter, the fine dust particles are captured and collected in the filter bag 12 and purified air is discharged from the main body 1 via the exhaust outlets 9 together with the negative ions and/or the positive ions generated by the ion generator 13.

When the ion generator 13 generates negative ions, the negative ions are rapidly discharged into a room with the purified air. Accordingly, physiological functions and autonomic nervous system of people exposed thereto are enhanced, e.g., relief from fatigue.

When the ion generator 13 generates positive ions, unpleasant odors and bacteria are collected on the positive ions, which are collected in the filter bag 12, thereby providing deodorization and anti-microbial action.

When the ion generator 13 generates both types of the ions, respective advantages in generation of positive and negative ions can be obtained at the same time. A sixth preferred embodiment of the present invention will now be described in detail with reference to FIG. 8.

Figure 8:
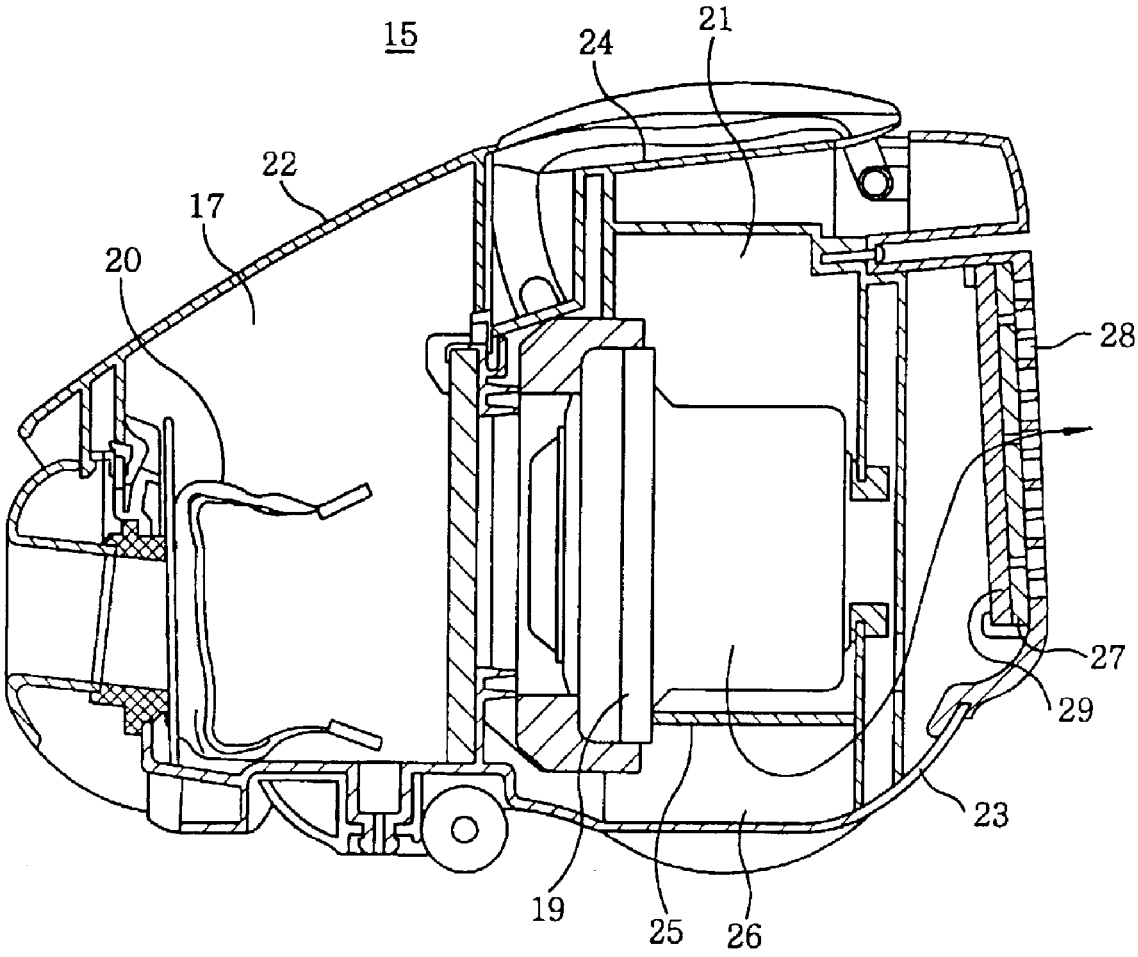
FIG. 8 depicts a side cross sectional view of a main body of a vacuum cleaner in accordance with a sixth preferred embodiment of the present invention.
Figure 9:
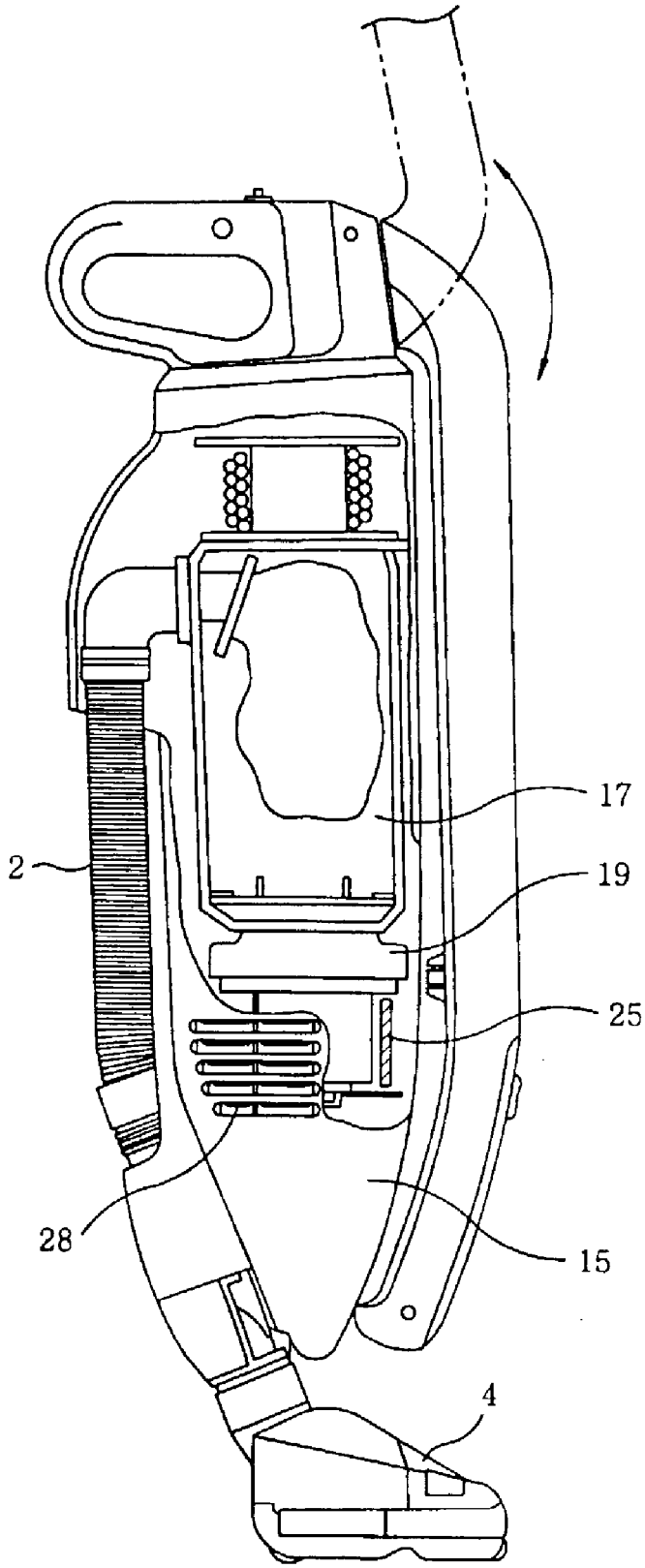
FIG. 9 describes a partial cross sectional view of another type of vacuum cleaner in accordance with the present invention.

In FIG. 8, reference numerals 25 and 27 represent ion generators C and D, respectively, for generating negative ions.

The negative ion generator C 25 is installed in the air discharge passage 26 to ionize the air by generating static electricity as a result of friction with the moving air through the electric blower 19, and the negative ion generator D 27 is disposed just before the exhaust openings 28 to cause frictional contact with air passing therethrough. The negative ion generators C 25 and D 27 are made of, e.g., a fabric selected from the group consisting of an acrylic fiber, vinyl chloride fiber and polypropylene fiber.

Further, the reference numeral 29 presents a scent filter providing a scent, which can be provided, e.g., on the ion generator D 27.

When suction generated by the electric blower 19, creating an air flow, dirt particles travel through the suction head 4, the extension tube 3 and the hose 2 into the filter bag 20 disposed in the dirt collection chamber 17. The air flowing through the dirt collection chamber 17 passes the electric blower 19 to come into frictional contact with the negative ion generator C 25. Thereafter, the negative ion generator C 25 generates negative ions, which are then carried by the air flow. Subsequently, the air flow carrying the negative ions passes through the scent filter 29, at which time, the scent filter 29 generates a scent. Thereafter, the scented airflow comes into frictional contact with the negative ion generator D 27 to further generate negative ions. The negative ion generator D 27 is placed close to the exhaust openings 28, so as to efficiently discharge the negative ions generated thereby from the main body 15.

The negative ion generators C 25 and D 27 using the frictional force in the main body 15 do not require a separate ion generator therein, thereby minimizing the size thereof as well as facilitating the handling thereof. Specifically, since the negative ion generator C 25 is installed close to the electric blower 19 in the main body 15, i.e., at a location where the flow rate is high, it yields relatively large amount of the negative ions. Moreover, since the negative ion generator D 27 is placed close to the exhaust openings 28, the negative ions generated thereby are effectively discharged from the main body 15.

By utilizing the suction to create air flow generated by the electric blower 19 in generating the ions, the present invention does not require a separate driving source for the ion generator. This simplifies the construction of the vacuum cleaner and reduces cost thereof, and further effectively generates the negative ions. Further, the ion generator C 25 generating negative ions is made of fabric, therefore, when the airflow passes therethrough, negative ions are generated. Thus, such configuration does not require a separate driving source for the ion generator. Accordingly, such configuration simplifies the construction of the ion generators, reduces the cost thereof, and furthermore effectively generates negative ions. Moreover, the scent filter 29 providing scent improves the cleaning environment.

Despite a plurality of negative ion generators present in the sixth preferred embodiment, identical results can be obtained with only a single negative ion generator. Further, the ion generators may be applied to an upright vacuum cleaner (see FIG. 9) as long as a vacuum cleaner is equipped with an electric blower. In the present exemplary embodiment, the ion generators, which are installed in the main body 15, may be placed at other parts of the vacuum cleaner, e.g., in the suction head 4, the extension tube 3 or the hose 2.

Figure 10:
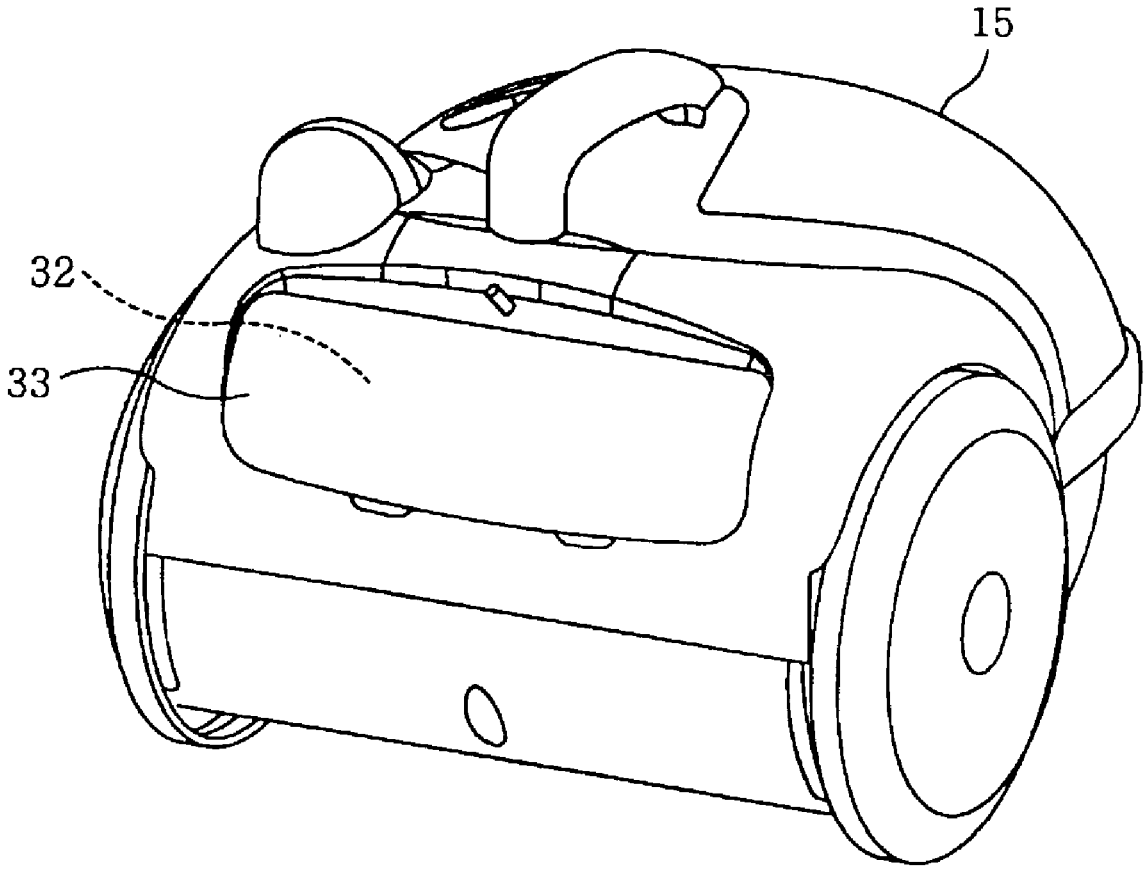
FIG. 10 provides a rear perspective view of a main body of a vacuum cleaner in accordance with a seventh preferred embodiment of the present invention.
Figure 11:
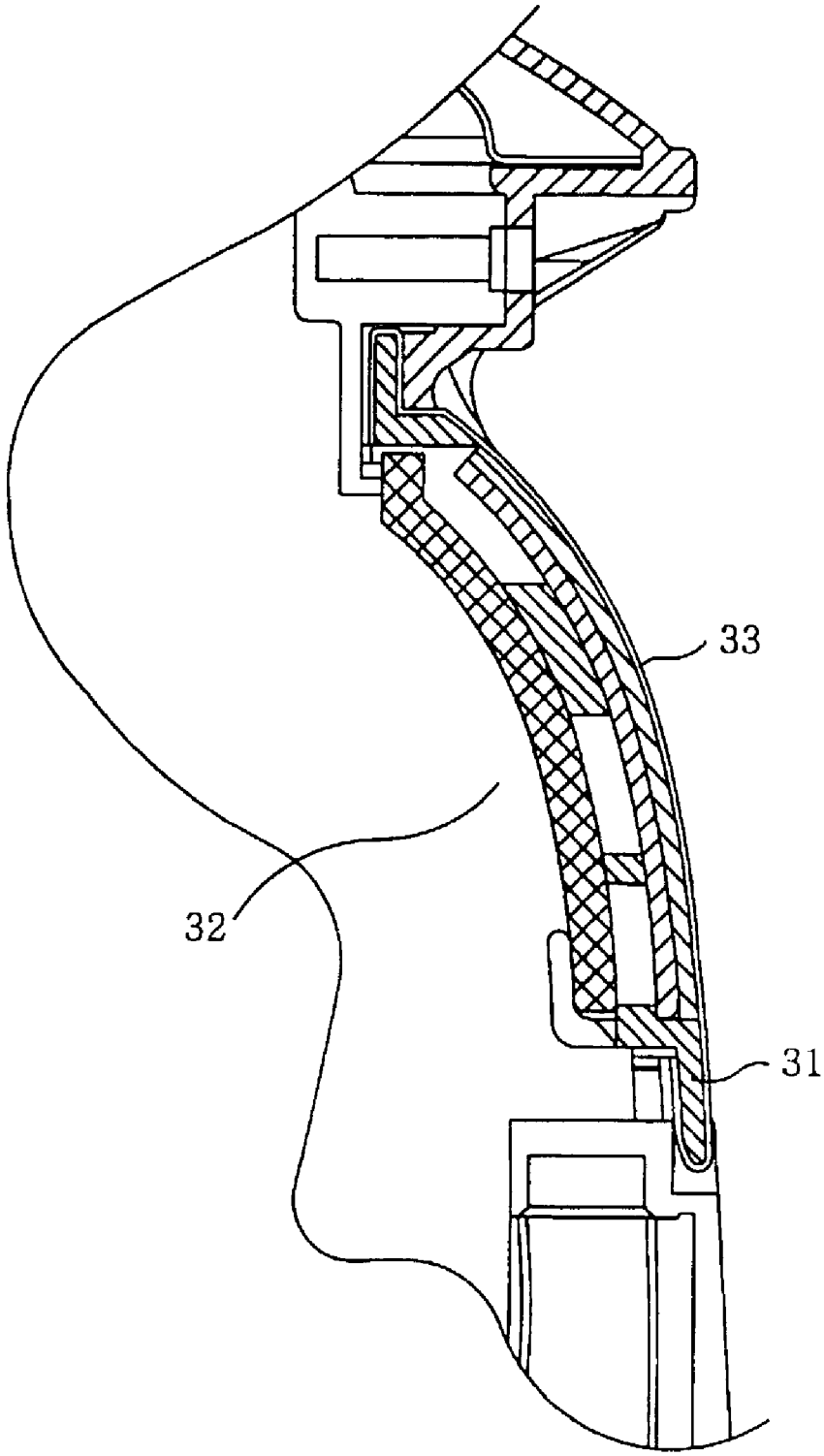
FIG. 11 exemplifies a partial cross sectional view of the main body of FIG. 10.

A seventh preferred embodiment of the present invention will now be described in detail with reference to FIGS. 10 and 11.

Reference numerals 32 and 31 represent an exhaust hole for discharging moving air, created by suction generated by the electric blower 19, and a frame detachably mounted on the exhaust hole 32, respectively. The exhaust hole 32 is disposed on an exterior of the main body 15 and mounted on the frame 31 is an ion generator E 33 made of, e.g., an acrylic fiber, vinyl chloride fiber or polypropylene fiber, for generating negative ions.

Since the ion generator E 33 is installed on the exterior of the main body 15, exhaust a flow from the electric blower 19 generates negative ions, and thus obtained negative ions are transferred by the air flow to be discharged from the main body 15.

The ion generator E 33 installed on the exterior of the main body 15 enclosing the exhaust hole 32, enables effective use of the air flow, generating ions and effective discharge of the ions, therefrom. Further, since the frame 31 provided with the ion generator E 33 is detachably mounted on the main body 15, removal thereof for cleaning can easily be performed.

Figure 12:
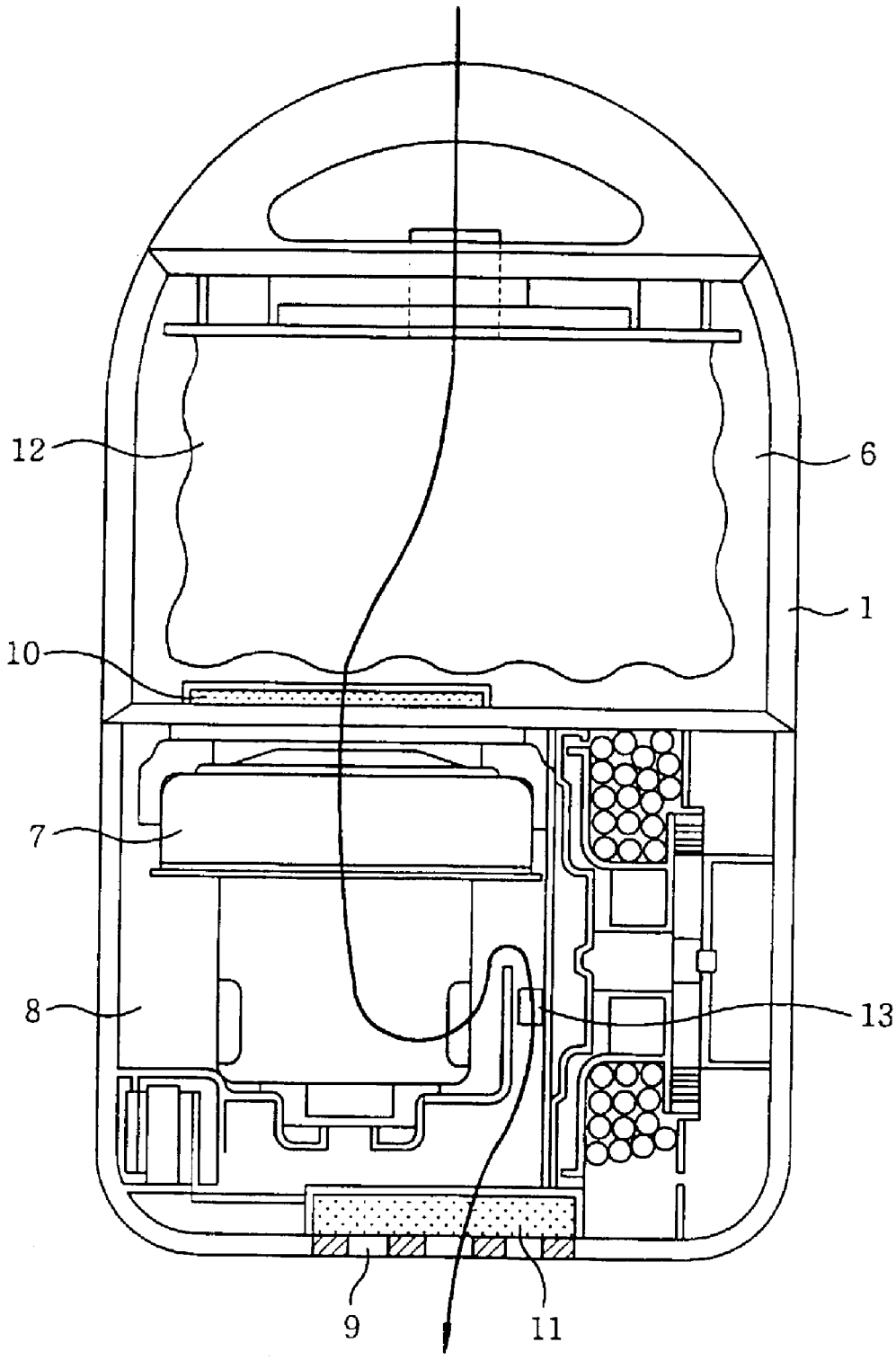
FIG. 12 represents a schematic internal structure of a main body of a vacuum cleaner in accordance with an eighth preferred embodiment of the present invention.

An eighth preferred embodiment of the present invention will now be described in detail with reference to FIG. 12.

As shown, an ion generator 13 for generating negative ion and/or positive ions is installed between downstream of the electric blower 7 and the exhaust port 9. In such a construction, the ions generated by the ion generator 13 are carried on the exhaust air flow passing through the electric blower 7 to be discharged via the exhaust air filter 11.

When the negative ions generated by the ion generator 13 are discharged via the exhaust air filter 11 and the exhaust outlets 9, dust particles are negatively charged by the discharged negative ions are attracted to the positively charged exhaust air filter 11, thereby preventing such dust particles from escaping from the main body 1.

When the ion generator 13 generates the positive ions, positive electric potential of the exhaust air filter 11 proportional to the operation time of the electric blower 7 reaches higher state, which in turn repels dirt particles from the exhaust air filter 11, reducing the amount of dirt particles to be discharged therethrough. Moreover, such rise in electric potential significantly enhances deodorization and anti-microbial action.

As another approach for generating the ions, an ion generator equipped with high DC voltage device and one or more acicular electrodes may be employed. Such acicular electrodes may be installed in the air passage of the vacuum cleaner. The acicular electrodes having tapered ends enable corona discharge and improve efficiency in ion discharge.

Figure 13:
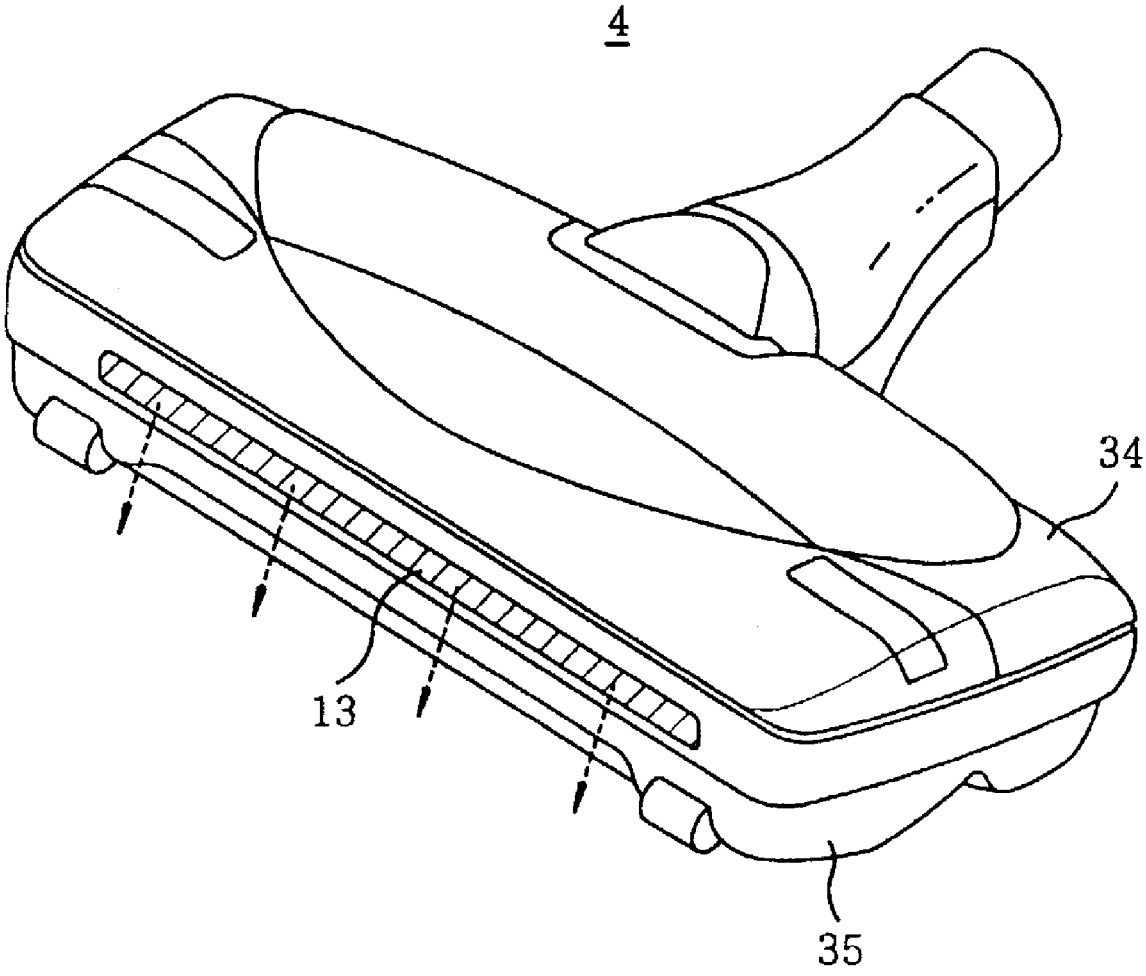
FIG. 13 illustrates a perspective view of a suction head of a vacuum cleaner in accordance with a ninth preferred embodiment of the present invention.
Figure 14:
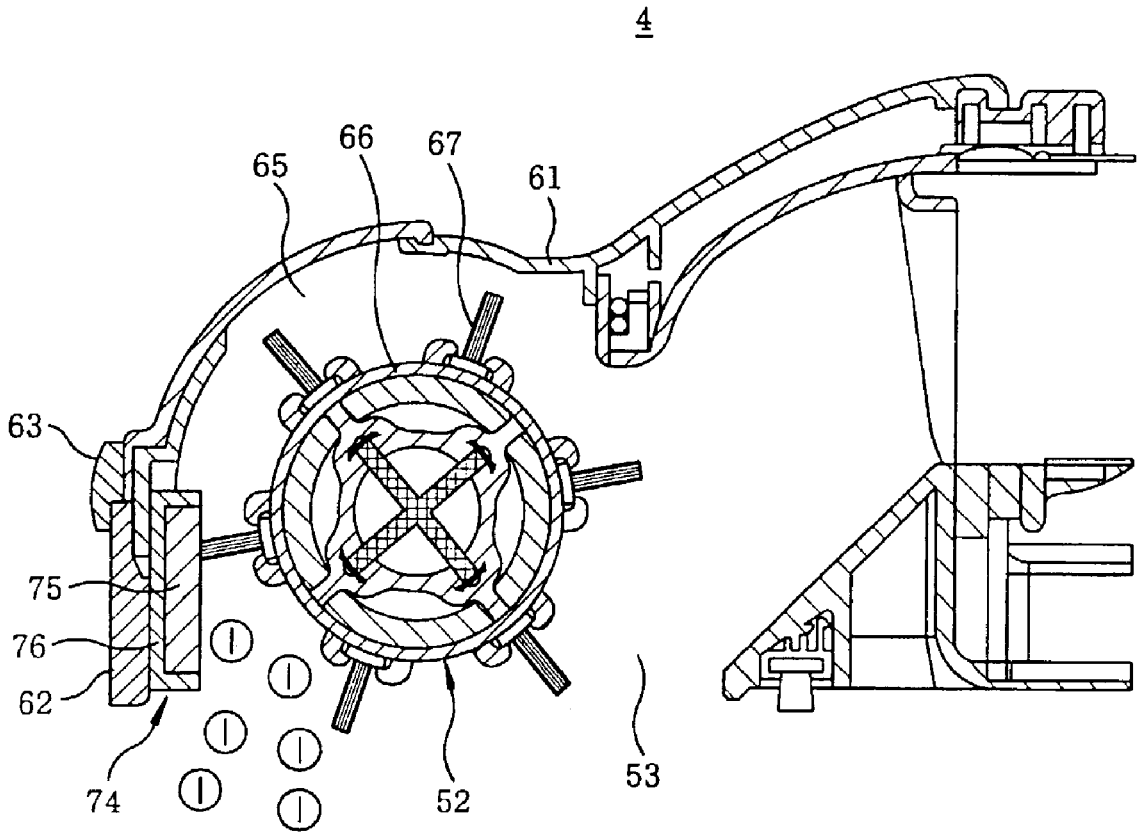
FIG. 14 sets forth a side cross sectional view of a main part of a suction head included in a vacuum cleaner in accordance with a tenth preferred embodiment of the present invention.
Figure 15:
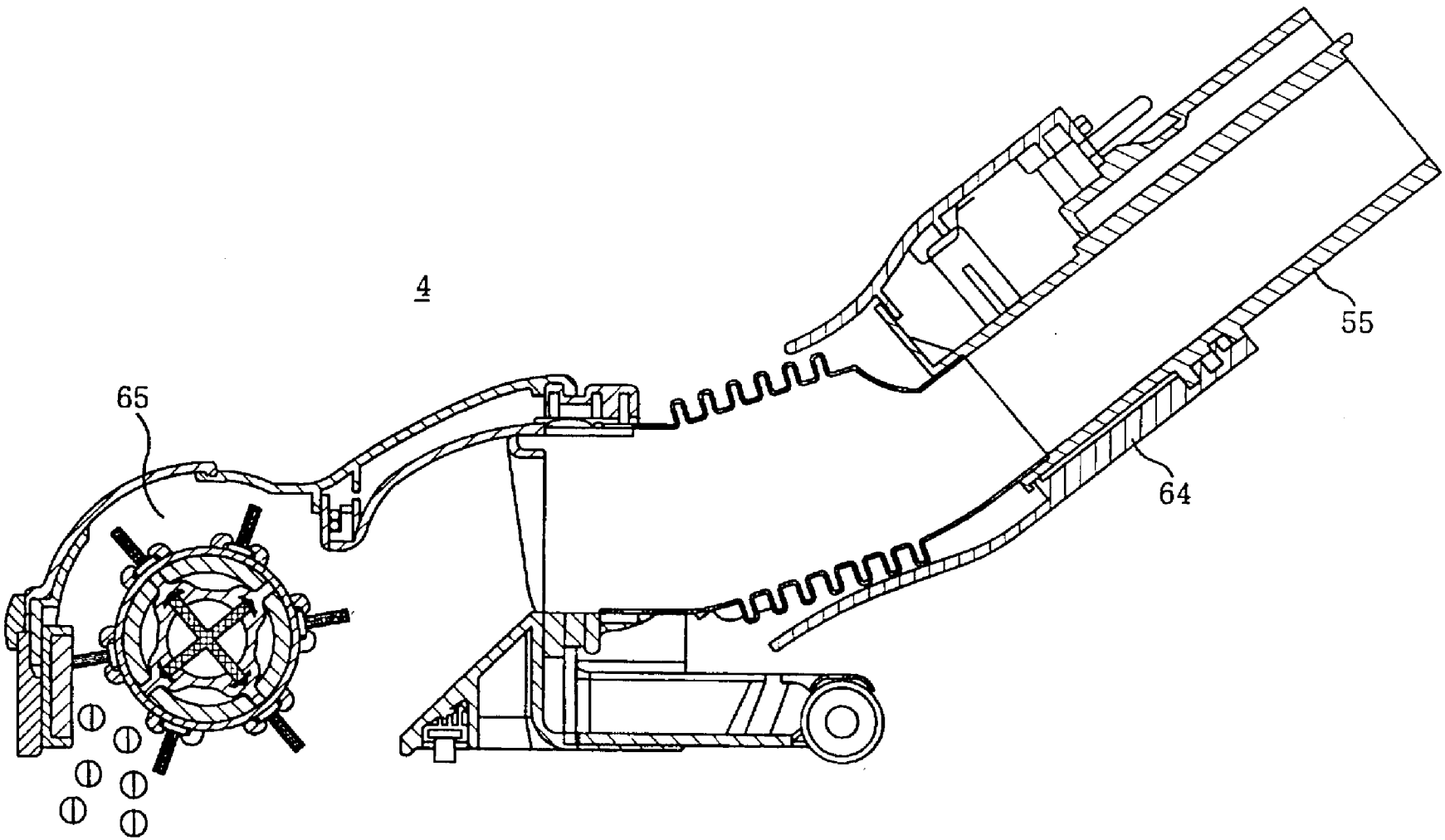
FIG. 15 discloses a side cross sectional view of the suction head of the vacuum cleaner in accordance with the tenth preferred embodiment of the present invention.
Figure 16:
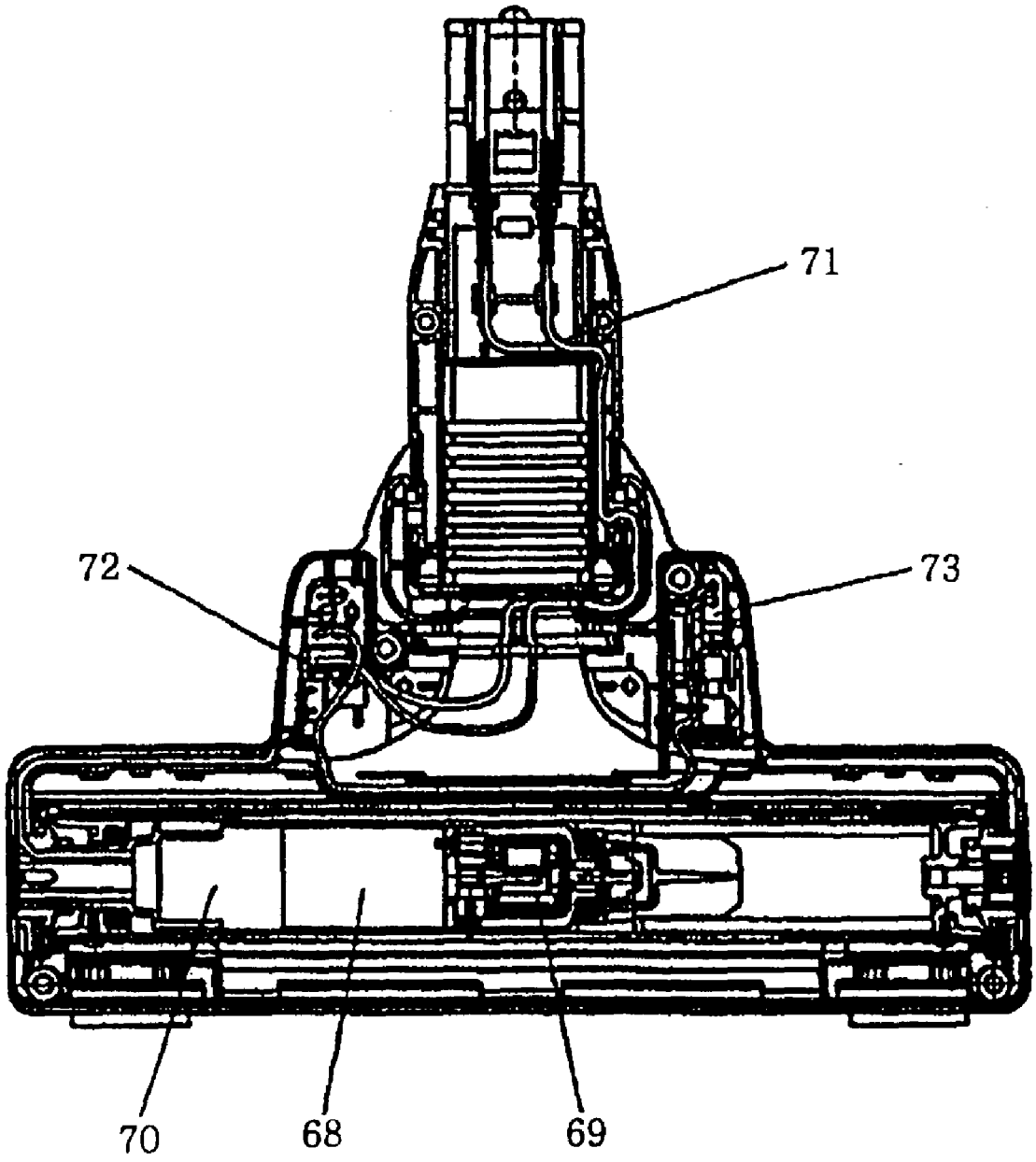
FIG. 16 offers a plan view of the suction head shown in FIG. 15 after removing an upper member.

A ninth preferred embodiment of the present invention will now be described in detail with reference to FIG. 13.

Reference numerals 34 and 35 represent an upper member and a lower member which are included in the suction head 4 in conjunction with each other, respectively. At a front part of the lower member 35 is installed an ion generator 13 for generating negative ions and/or positive ions in such a manner that the ions generated thereby are discharged onto the floor to be cleaned.

In such a construction, a positively charged floor is neutralized by the negative ions generated by the ion generator 13 which in turn facilitates collection of dirt particles therefrom, increasing dirt collection efficiency.

When the ion generator 13 generates positive ions, the positive ions improve deodorization and antimicrobial action to the floor.

In a case of the ion generator 13 generating both negative and positive ions, it has advantages of both cases mentioned above.

A tenth preferred embodiment of the present invention will now be described in detail with reference to FIGS. 14 to 17.

The tenth preferred embodiment includes a suction head 4 divided into an upper member 61 and a lower member 62 defining an outline thereof, a dirt sucking chamber 65 surrounded by the upper member 61 and the lower member 62, a bumper 63 at its front part, and a rotatable neck pipe 64 communicating with the dirt sucking chamber 65 at its rear part.

The bumper 63 is provided at the adjoining position of the upper member 61 and the lower member 62 and made of, e.g., an elastomer, a polypropylene("PP") or the like.

The neck pipe 64 is coupled with a connection pipe 55 to communicate with the extension tube 3 therethrough, enabling rotation of the connection pipe 55.

The dirt sucking chamber 65 is provided with a rotary brush 52 therein and a dirt sucking chamber inlet 53 at its bottom.

The rotary brush 52, which is rotatably installed in the dirt sucking chamber 65, has generally a cylindrical holder 66 made of, e.g., a thermoplastic resin such as an acrylonitrile butadiene styrene("ABS"), poly styrene, polypropylene and the like, and a plurality of discrete bristle clusters 67 provided around the periphery of the holder 66 for picking up dirt particles. The bristle clusters 67 are normally projected from the periphery of the holder 66 and are spaced apart at a predetermined interval. The bristle clusters 67 may be formed in a spiral shape or a V-shape. In this preferred embodiment, the bristle clusters 67 are employed as a means for picking up dirt particles, but thin plate-shaped blades and/or strips to which dirt particles are attracted can be employed.

The holder 66 has an electric motor 68 for rotating the rotary brush 52 and a reduction gear 69 for lowering the number of rotation of the electric motor 68. On the electric motor 68, e.g., a commutator motor is a motor substrate 70 for mounting thereon a rectifier (not shown) for rectifying a supply voltage, a noise controller (not shown) and the like. The motor substrate 70 is connected to one end of the ends of a lead 71 and the other end of which is connected to the main body 1 via the connection pipe 55. In such a construction, the electric motor 68 is driven in terms of voltage obtained by rectifying the supply voltage. Furthermore, the rotating number of the electric motor 68 is set to range from about 10000 rpm to about 15000 rpm and that of the rotary brush 52 is set to range from about 1200 rpm to 3000 rpm on the carpet.

Reference numeral 72 represents an overcurrent protection device having positive temperature coefficient thermistor, for preventing an excess current from flowing into the electric motor 68.

In this preferred embodiment, the electric motor 68 is mounted on the holder 66 as the rotary brush driving means, but other brush driving means may be used. For instance, a belt strained between the electric motor and the rotary brush or suction airflow for rotating the bristle clusters of the rotary brush may be used.

Reference numeral 73 represents a switch unit provided with a limit switch (not shown) for controlling an activation of the electric motor 68. By turning on or off the limit switch to selectively supply the electric power, the electric motor 68 is activated or stopped. The switch unit 73 determines whether the suction head 4 is in contact with the target cleaning surface, and only if it is in contact, the rotary brush 52 is driven.

In the dirt sucking chamber 65, which is located opposite to the neck pipe 64, and communicated with the main body 1, is provided an ion generating unit 74, the ion generating unit 74 being supported by the upper member 61 and the lower member 62. The ion generating unit 74 has an ion generator F 75 made of, e.g., material readily charged with negative electric charge in a table (see FIG. 17) showing electrification rank such as Teflon, vinyl chloride and the like and supported on a support plate 76.

The bristle clusters 67 are preferably made of material that are readily chargeable positively, which can be found in the electrification table ranking such order. Elements such as nylon, sheep wool and the like, are included in the table.

When the holder 66 rotates, the bristle clusters 67 fixed thereto come into contact with the ion generator F 75. In order to ensure a stable contact of the bristle clusters 67 with the ion generator F 75, it is preferable that the bristle clusters 67 have a length greater by, e.g., about 0.5 mm than a gap between the holder 66 and the ion generator F 75. Moreover, it is preferable that the ion generator F 75 is located close to the target surface to-be-cleaned, e.g., while maintaining the distance of about 1 mm to about 10 mm therebetween. Furthermore, it is preferable that the ion generator F 75 is mounted on the support plate 76 to be protruding therefrom toward the holder 66, which allows the bristle clusters 67 to come into direct contact with a surface of the ion generator F 75. Meanwhile, the thickness of the ion generator F 75 is preferably set to, e.g., about 0.1 mm or greater.

The contact surface of the ion generator F 75 having contact with the bristle clusters 67 does not require special processing thereof, nevertheless various workings for increasing an area coming into practical contact with the bristle clusters 67 may be carried out. For instance, embossment or half blanking by a Thomson method or a press method may be carried out on the contact surface of the ion generator F 75 in a direction substantially paralleled, substantially perpendicular, and/or slanted to a longitudinal direction thereof. Further, the contact surface of the ion generator F 75 may be corrugated so as to increase roughness thereof.

In operation, when the main body 1 is electrified and the switch unit 73 recognizes the suction head 4 is in contact with the target cleaning surface, the electrical power is supplied to the electric motor 68 via the main body 1, the hose 2, the extension tube 3, the connection pipe 55, the lead 71 and the motor substrate 70 which in turn drives the electric motor 68. The driving force of the electric motor 68 is transmitted to the rotary brush 52 through the reduction gear 69.

When the suction head 4 progresses, the rotary brush 52 rotates in an identical direction as the progress direction of the suction head 4. This allows the rotary brush 52 to draw dirt in the dirt sucking chamber 65 from the target cleaning surface, in conjunction with the air flow generated by the electric blower 7 of the main body 1. Thus drawn dirt particles pass through the connection pipe 55 and the hose 2 to be collected in the dirt collection chamber 6.

The bristle clusters 67 and the ion generator F 75 are respectively made of material readily charged with positive electricity and negative electricity in the electrification rank showing table. When the bristle clusters 67 and the ion generator F 75 are rubbed by each other, the ion generator F 75 is negatively charged to discharge negative electric charges. The discharged negative electric charges are attracted to dirt particles on the target cleaning surface. Accordingly, the dirt particles having negative electric charges are drawn through the dirt sucking chamber inlet 53 by the air flow and positive polarity of the bristle clusters 67. When the number of rotation of the rotary brush 52 ranges from about 1200 rpm to about 3000 rpm, the number of negative ions discharged from the ion generator F 75 ranges from about ten thousand to about one million, which allows for a collection of fine dust particles that were incapable of being drawn by mere air flow. This increases the dirt collection efficiency when cleaning, particularly, a wood floor of a house, improving the cleaning environment and the cleaning efficiency.

Since, when the ion generator F 75 comes into contact with the bristle clusters 67, the contact surface thereof is directly rubbed by the bristle clusters 67, the charge amount increases. Further, by processing the contact surface of the ion generator F 75, it is possible to secure a desired amount of the negative ions generated by the ion generator F 75.

Moreover, since the ion generator F 75 is located and comes into frictional contact with the bristle clusters 67 near the target cleaning surface, the negative ions generated thereby are discharged toward the target cleaning surface, thereby improving dirt collection efficiency.

Although not shown, the bristle clusters of the rotary brush 52 may differ in thickness and/or length from each other. This enables the economical use of the bristle clusters and further enabling uniform contact with the ion generator F 75 to stably generate the ions.

Referring to FIGS. 18A, 18B and 19A to 19C, an eleventh preferred embodiment of the present invention is explained.

A suction head 4 includes a lower opening portion 82, a wall portion 83 surrounding the lower opening portion 82, and a bristle packet 84 altering in electrification ranks.

Further, a connection pipe 87 connected with the extension tube 3 is rotatably prepared on a rear section of the lower opening portion 82.

Figure 18A:
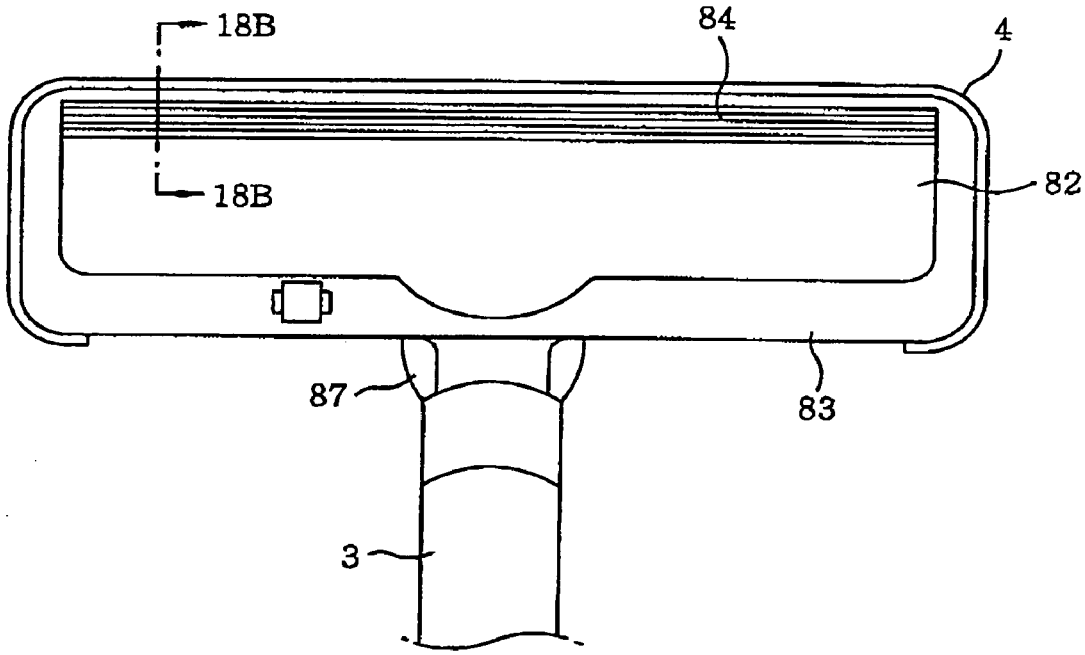
FIG. 18A describes a bottom view of a suction head of a vacuum cleaner in accordance with an eleventh preferred embodiment of the present invention.
Figure 18B:
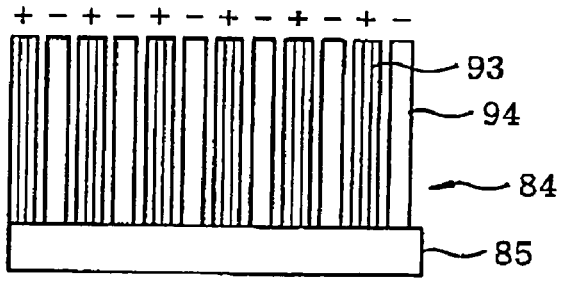
FIG. 18B provides a cross sectional view taken along the line 18B—18B in FIG. 18A.

As shown in FIG. 18B, the bristle packet 84 has a first bristle cluster 93 and a second bristle cluster 94, wherein the first bristle cluster 93 and the second bristle cluster 94 are made of materials that are on a positive side and a negative side of the electrification rank, respectively. When the bristle packet 84 scrubs the target cleaning surface, the first bristle cluster 93 and the second bristle cluster 94 are rubbed against each other, so that the second bristle cluster 94 is electrified to have the negative polarity. The second bristle cluster 94 having the negative polarity emits negative electric charges while in contact with the target cleaning surface. Accordingly, negative ions can be effectively bonded with dust particles on the target cleaning surface.

Figure 19A:
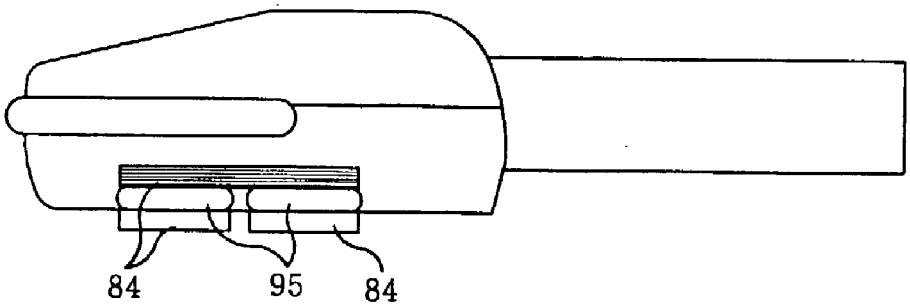
FIG. 19A exemplifies a side view of a modification of the suction head of a vacuum cleaner in accordance with the eleventh preferred embodiment of the present invention.
Figure 19B:
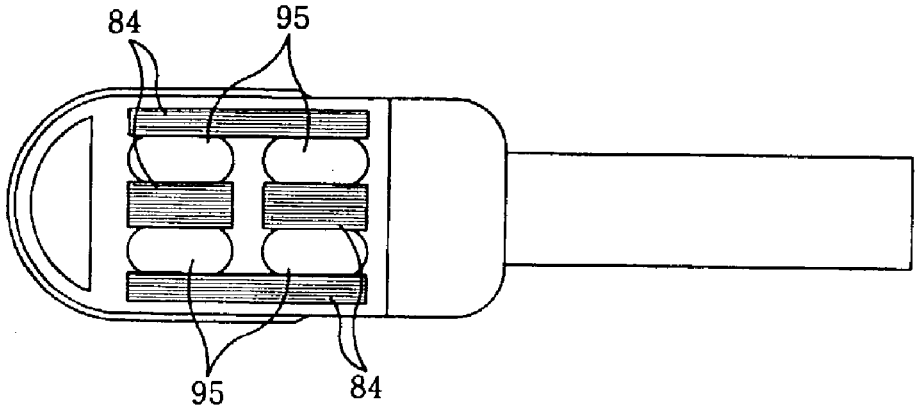
FIG. 19B describes a bottom view of the modification of the suction head shown in FIG. 19A.
Figure 19C:
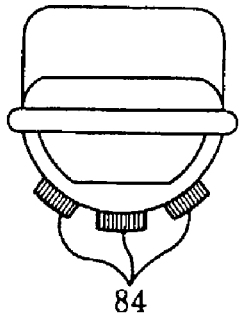
FIG. 19C provides a front view of the modification of the suction head shown in FIG. 19A.

As shown in FIGS. 19A to 19C, the wall portion 83 of the suction head 4 may be formed of a circular arc shape and may have a plurality of opening portions 95. A plurality of bristle packets 84 having different electrification ranks as in FIG. 18B may be mounted on a top arc portion and/or side portions of the suction head 4, wherein the opening portions 95 may be positioned on the side portions as well as a bottom portion thereof. The circular arc-shaped portion of the suction head 4 is useful in cleaning steps. That is to say, because the plurality of bristle packets 84 can contact even a perpendicular surface of a step, negative ions are effectively diffused and dust particles are efficiently raised from the recessed region. Further, because the opening portions 95 are formed on various portions of the suction head 4, dust particles can be more efficiently raised and removed.

The materials of bristle clusters are selected from a first group of Teflon(R) and vinyl chloride that would be negatively electrified and a second group of nylon and wool that would be positively electrified. The bristle packet 84 is formed by combining these two types of bristle clusters.

As shown in FIG. 18B, the bristle packet 84 may have a sheet of ground fabric 85 joined together with the first bristle cluster 93 and the second bristle cluster 94. This configuration provides a better friction efficiency between the first and the second bristle clusters 93 and 94 having different electrification ranks, thereby producing more negative ions. Accordingly, the negative ions can be more effectively diffused on the target cleaning surface and, therefore, the collection efficiency can be enhanced. Further, because the fabrication process therefor is relatively simple, fabrication cost can be reduced.

Alternatively, the bristle packet 84 may be made of a nap fabric, which is fabricated by intensively napping a surface of a sheet of fabric. In case of using the nap fabric, both sides of the opening portion 95 are closed to enhance the collection efficiency thereof, such that dust particles heaped on a concave region can be raised in accordance with the movement of the suction head 4 and then introduced into the opening portion 95, wherein the nap fabric gives an effect of cleaning the target cleaning surface and simultaneously serves as a bumper to prevent scratches of furniture or the target cleaning surface. The nap fabric may be a felt.

Figure 20A:
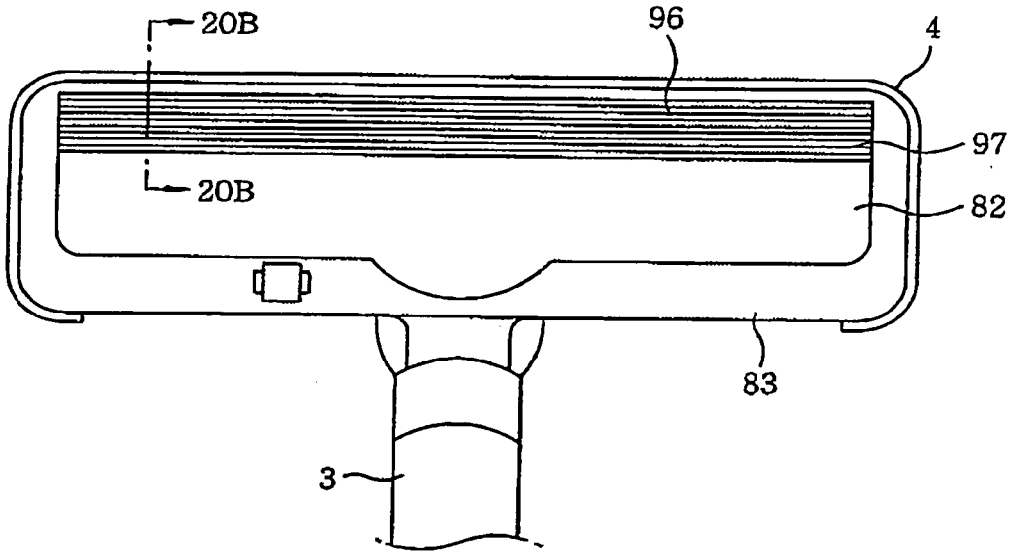
FIG. 20A presents a bottom view of a suction head of a vacuum cleaner in accordance with a twelfth preferred embodiment of the present invention.
Figure 20B:
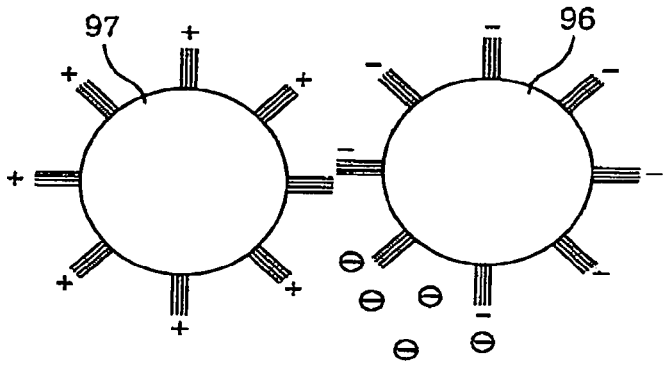
FIG. 20B shows an enlarged cross sectional view taken along the line 20B—20B in FIG. 20A.
Figure 20C:
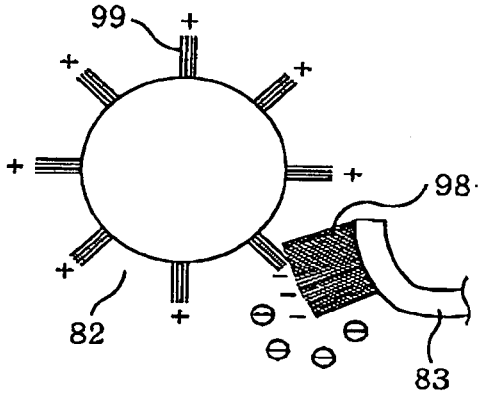
FIG. 20C is an enlarged cross sectional view taken along the line 20B—20B, for setting forth a modification of the suction head shown in FIG. 20A.

Referring to FIGS. 20A to 20C, a twelfth preferred embodiment of the present invention is explained.

FIG. 20B illustrates a configuration of a plurality of bristle clusters having different electrification ranks, each being in the form of a rotary structure. Bristles of a first bristle cluster packet 96 are on a negative side of the electrification rank and those of the second bristle cluster packet 97 are on a positive side thereof. The movement of the suction head 4 on a target cleaning surface to be cleaned makes the first and the second bristle cluster packets 96 and 97 rotate to be rubbed against each other, so that negative ions are produced at the first bristle cluster packet 96 having the negative electrification rank.

Since the brushes of the first and the second bristle cluster packet 96 and 97 are directly in contact with the target cleaning surface, negative ions can be effectively bonded with dust particles on the target cleaning surface. Further, the rotation of the first and the second bristle cluster packets 96 and 97 can enhance the efficiency of raising dust particles. The bristle cluster packets 96 and 97 may be rotated by a suction airflow through the lower opening portion 82 or by an electric motor. Instead of being positioned in the lower opening portion 82, the bristle cluster packets 96 and 97 may be positioned at peripheries thereof, e.g., near a front side of the lower opening portion 82, without changing the effects.

In FIG. 20C, one of bristle cluster packets is fixed while the other is rotatable. A fixed bristle cluster 98 having a negative electrification rank is fixed on a wall portion 83 and a rotary bristle cluster 99 having the opposite electrification rank is rotatably formed to contact a target cleaning surface to be cleaned and the fixed bristle cluster 98. During the cleaning, the fixed bristle cluster 98 is rubbed by the rotary bristle cluster 99 rotated by friction against the target cleaning surface, thereby producing negative ions. Since the fixed bristle cluster 98 is prepared on the wall portion 83, it can contact the target cleaning surface and therefore effectively diffuse negative ions thereon to collect dust particles.

The rotary bristle cluster 99 may be in the form of being rotated by an airflow through the lower opening portion 82 or by an electric motor. Instead of being positioned in the lower opening portion 82, the rotary bristle cluster 99 may be positioned at peripheries thereof, e.g., near a front side of the lower opening portion 82, without changing the effects.

Alternatively, a bristle cluster packet may be formed by combining positive brushes having the positive electrification rank with negative ones having the negative electrification, wherein rotation of the bristle cluster packet against a target cleaning surface makes the brushes rubbed against each other such that the negative brushes can be negatively electrified to emit negative ions.

Further, there may be two or more of the bristle packet 84, the bristle cluster packets 96 and 97, and bristle cluster 98 and 99, each being employed either on the wall portion 83 or in the lower opening portion 82. Proper combinations of the bristle packet 84, the bristle cluster packets 96 and 97, and bristle cluster 98 and 99, installed at the suction head 4, may enhance the collection efficiency.

Materials of the bristle cluster packet 96 and the fixed bristle cluster 98 are selected from a first group of Teflon(R) and vinyl chloride that would be negatively electrified. Materials of the bristle cluster packet 97 and the rotary bristle cluster 99 are selected from a second group of nylon and wool that would be positively electrified.

Further, the wall portion of the suction head 4 in this preferred embodiment may be formed of a circular arc shape and may have a plurality of opening portions. Particularly, because the bristle cluster packet in this preferred embodiment is rotatable, the efficiency of raising dust particles can be enhanced.

While the invention has been shown and described with respect to the preferred embodiments, it will be understood by those skilled in the art that various changes and modifications may be made without departing from the spirit and scope of the invention as defined in the following claims.

What is claimed is:

1. A vacuum cleaner comprising:

an electric blower for generating a suction air flow;

a suction head in communication with the electric blower for drawing in dirt;

a rotary brush having a plurality of bristle clusters; and an ion generator for generating negative ions and/or positive ions by coming into frictional contact with the bristle clusters of the rotary brush, wherein the ions generated from the ion generator are discharged and attracted to dirt particles so that the dirt particles are charged with the ions and drawn by opposite polarity of the bristle clusters.

2. The vacuum cleaner of claim 1, wherein the ion generator is installed at upstream of the air flow of the electric blower.

3. A vacuum cleaner comprising:

an electric blower for generating a suction air flow;

a suction head in communication with the electric blower for drawing in dirt;

a dirt collecting means for capturing and collecting dirt;

a rotary brush having a plurality of bristle clusters; and an ion generator placed in the suction head, for generating negative ions and/or positive ions by coming into frictional contact with the bristle clusters of the rotary brush, wherein the ions generated from the ion generator are discharged and attracted to dirt particles so that the dirt particles are charged with the ions and drawn by opposite polarity of the bristle clusters.

4. The vacuum cleaner of any one of claim 2, or 3, wherein the ion generator is made of a fabric readily charged with negative electricity and/or positive electricity, negative and/or positive ions are generated by making the suction air flow and/or the exhaust air flow formed by the electric blower pass through the fabric constituting the ion generator.

5. A suction head for use in a vacuum cleaner comprising:

a dirt sucking chamber provided with a rotary brush, the rotary brush having a plurality of bristle clusters and the bristle clusters being made of a first material to be charged with electricity; and an ion generator for generating negative ions and/or positive ions, the ion generator being made of a second material to be charged with electricity, the second material having a different electrification rank from that of the first material, wherein the ion generator is charged with electricity by coming into frictional contact with the bristle clusters of the rotary brush and the ions generated from the ion generator are discharged from the suction head to be attracted to dirt particles so that the dirt particles are charged with the ions and drawn by opposite polarity of the bristle clusters.

6. The suction head of claim 5, wherein the second material is more readily charged with negative electricity than the first material and thus the ion generator is charged with negative electricity by coming into frictional contact with the bristle clusters of the rotary brush, thereby generating the negative ions.

7. The suction head of claim 6, wherein the bristle clusters of the rotary brush are different in thickness and/or length from each other.

8. The suction head of claim 7, wherein the bristle clusters of the rotary brush are made of an identical material.

9. The suction head of claim 5, wherein the ion generator has thickness of about 0.1 mm or greater.

10. The suction head of claim 5, wherein the ion generator is installed on an inside front of the dirt sucking chamber to extend down to a position under a vertical position of the center of rotation of the rotary brush.

11. The suction head of claim 5, wherein the bristle clusters have a length greater by about 0.5 mm than a gap between the rotary brush and the ion generator.

12. The suction head of claim 5, wherein the bristle clusters of the rotary brush are different in thickness and/or length from each other.

13. The suction head of claim 12, wherein the bristle clusters of the rotary brush are made of an identical material.

14. The suction head of claim 5, wherein a first material constituting the bristle clusters of the rotary brush is more readily charged with negative electricity than a second material constituting the ion generator.

15. The suction head of claim 14, wherein the first material is made of polystyrene such as nylon to be readily charged with positive electricity and the second material is made of a thermoplastic resin or vinyl chloride.

16. The suction head of claim 5, wherein the rotary brush is rotated by an electric motor, or a suction air flow or an exhaust air flow generated by the electric blower.

17. A suction head for use in a vacuum cleaner comprising:

a dirt sucking chamber provided with a rotary brush, the rotary brush having a plurality of bristle clusters and the bristle clusters being made of a first material to be charged with electricity; and an ion generator for generating negative ions and/or positive ions, the ion generator being made of a second material to be charged with electricity, the second material having a different electrification rank from that of the first material, wherein the ion generator is charged with electricity by coming into frictional contact with the bristle clusters of the rotary brush and the ions generated from the ion generator is discharged from the suction head to be attracted to dirt particles, wherein the rotary brush further has a holder for holding the bristle clusters, the holder being made of a third material whose electrification rank is between those of the first and the second material.

18. A vacuum cleaner comprising:

a main body including an electric blower for providing a suction air flow; and a suction head of any one of claims 5–16 & 17, the suction head being communicated with the electric blower.

* * * * *